US008360607B2

(12) United States Patent
Bretschneider et al.

(10) Patent No.: US 8,360,607 B2
(45) Date of Patent: Jan. 29, 2013

(54) LIGHTING UNIT WITH HEAT-DISSIPATING CHIMNEY

(75) Inventors: Eric Bretschneider, Satellite Beach, FL (US); Zach Berkowitz, San Francisco, CA (US); Randall Sosnick, Mill Valley, CA (US); Lisa Pattison, Johnson City, TN (US); P. Morgan Pattison, Johnson City, TN (US)

(73) Assignee: NEXT Lighting Corp., San Francisco, CA (US)

( * ) Notice: Subject to any disclaimer, the term of this patent is extended or adjusted under 35 U.S.C. 154(b) by 0 days.

(21) Appl. No.: 13/029,032

(22) Filed: Feb. 16, 2011

(65) Prior Publication Data

US 2011/0199769 A1 Aug. 18, 2011

Related U.S. Application Data

(60) Provisional application No. 61/338,268, filed on Feb. 17, 2010.

(51) Int. Cl.
*F21V 29/00* (2006.01)

(52) U.S. Cl. ..... 362/249.02; 362/373; 362/547; 362/218; 362/264; 362/294

(58) Field of Classification Search ..... 362/249.02, 362/547, 218, 264, 249.01, 312
See application file for complete search history.

(56) References Cited

U.S. PATENT DOCUMENTS

| | | | | |
|---|---|---|---|---|
| 6,513,949 | B1 | 2/2003 | Marshall et al. | |
| 6,577,073 | B2 | 6/2003 | Shimizu et al. | |
| 6,692,136 | B2 | 2/2004 | Marshall et al. | |
| 7,049,761 | B2 | 5/2006 | Timmermans et al. | |
| 7,114,830 | B2 | 10/2006 | Robertson et al. | |
| 7,128,454 | B2 * | 10/2006 | Kim et al. | 362/507 |
| 7,144,131 | B2 | 12/2006 | Rains | |
| 7,213,940 | B1 | 5/2007 | Van de Ven et al. | |
| 7,510,299 | B2 | 3/2009 | Timmermans et al. | |
| 7,618,157 | B1 | 11/2009 | Galvez et al. | |

(Continued)

FOREIGN PATENT DOCUMENTS

| | | | |
|---|---|---|---|
| WO | WO 2004/097291 | A1 | 11/2004 |
| WO | WO 2009/111098 | A2 | 9/2009 |

(Continued)

OTHER PUBLICATIONS

Kitai. Luminescent Materials and Applications. Wiley. May 27, 2008.

(Continued)

*Primary Examiner* — Sharon Payne
(74) *Attorney, Agent, or Firm* — Wilson Sonsini Goodrich & Rosati

(57) ABSTRACT

The invention provides systems and methods for providing illumination. A lighting unit may have a support structure, and one or more light emitting elements supported by a circuit board contacting the support structure. A first optical element and a second optical element may be provided. A remote luminescent material may be provided on one or more optical elements. Light emitting elements configured to excite the luminescent material such as highly efficient light emitting diodes may be directed towards the luminescent material. The support structure may be a heat dissipating element, which may conduct heat from a heat source to a surface of the support structure. The heat dissipating element may have a passageway permitting the formation of a convection path to dissipate heat from the support structure. Such lighting units may be used to replace conventional fluorescent light tubes or other lighting devices, or may be provided as standalone lighting units.

19 Claims, 14 Drawing Sheets

U.S. PATENT DOCUMENTS

| | | | | |
|---|---|---|---|---|
| 7,753,568 | B2 * | 7/2010 | Hu et al. | 362/373 |
| 7,819,567 | B2 | 10/2010 | Graham | |
| 8,066,414 | B2 | 11/2011 | Pabst et al. | |
| 8,147,101 | B2 * | 4/2012 | Tu et al. | 362/373 |
| 2007/0133212 | A1 | 6/2007 | Lin et al. | |
| 2008/0062680 | A1 | 3/2008 | Timmermans et al. | |
| 2008/0117627 | A1 | 5/2008 | Lu et al. | |
| 2008/0130285 | A1 | 6/2008 | Negley et al. | |
| 2008/0204888 | A1 | 8/2008 | Kan et al. | |
| 2009/0116223 | A1 * | 5/2009 | Hamada | 362/97.2 |
| 2009/0159919 | A1 | 6/2009 | Simon et al. | |
| 2009/0161359 | A1 | 6/2009 | Siemiet et al. | |
| 2009/0190348 | A1 | 7/2009 | Lin | |
| 2009/0219713 | A1 | 9/2009 | Siemiet et al. | |
| 2009/0290334 | A1 | 11/2009 | Ivey et al. | |
| 2009/0296384 | A1 | 12/2009 | Van de Ven et al. | |
| 2010/0020532 | A1 | 1/2010 | Negley | |
| 2010/0039815 | A1 * | 2/2010 | Jheng | 362/249.01 |
| 2010/0110678 | A1 | 5/2010 | Shen et al. | |
| 2010/0220469 | A1 | 9/2010 | Ivey et al. | |
| 2011/0199769 | A1 | 8/2011 | Bretschneider et al. | |

FOREIGN PATENT DOCUMENTS

| | | | |
|---|---|---|---|
| WO | WO 2009/111098 | A3 | 10/2009 |
| WO | WO 2009/129689 | A1 | 10/2009 |
| WO | WO 2009/131340 | A2 | 10/2009 |
| WO | WO 2009/140840 | A1 | 11/2009 |
| WO | WO 2009/140841 | A1 | 11/2009 |
| WO | WO 2009/154321 | A1 | 12/2009 |
| WO | WO 2009/158422 | A1 | 12/2009 |
| WO | WO 2009/131340 | A3 | 1/2010 |

OTHER PUBLICATIONS

Kobayashi. LCD Backlights (Wiley Series in Display Technology). Wiley (Jun. 15, 2009).

Kraft, et al. Electroluminescent Conjugated Polymers—Seeing Polymers in a New Light. Angew. Chem. Int. Ed. 1998; 37:402-428.

Li, et al. Light-Emitting Materials and Devices (Optical Science and Engineering Series). CRC Taylor & Francis. Sep. 12, 2006.

Miller. Cold Cathode Fluorescent Lighting, Chemical Publishing Co.. 1949.

Miyata. Organic Electroluminescent Materials and Devices. CRC. Jul. 1997.

Ono. Electroluminescent Displays. World Scientific Publishing Company. Jun. 1995.

Schubert. Light Emitting Diodes. Cambridge University Press. Jun. 9, 2003.

Shionoya, et al.. Phosphor Handbook. CRC Press 2nd Edition. Dec. 1, 2006.

Vij. Handbook of Electroluminescent Materials. Taylor & Francis. Feb. 2004.

U.S. Appl. No. 13/271,981, filed Oct. 12, 2011, Bretschneider et al.

U.S. Appl. No. 13/272,008, filed Oct. 12, 2011, Bretschneider et al.

International search report dated Oct. 11, 2001 for PCT Application No. US2011/025109.

* cited by examiner

LIGHTING UNIT WITH HEAT-DISSIPATING CHIMNEY

CROSS-REFERENCE

This application claims the benefit of U.S. Provisional Application No. 61/338,268, filed Feb. 17, 2010, which application is incorporated herein by reference.

BACKGROUND OF THE INVENTION

Fluorescent lamps are widely used for lighting in commercial buildings, residential spaces, as well as on transit buses and in outdoor lighting. Fluorescent lighting provides some advantages, such as improved efficiency, over other lighting options such as incandescent lighting. However, there are several drawbacks. Fluorescent lamps fail under excessive vibration, require a high operating voltage, consume a large amount of power, generally have poor color quality, they cannot be started in cold temperatures or in humid environments, they emit light in 360 degrees about the length of the lamp such that much light is lost in reflection, and they contain mercury, making the lamps difficult to dispose of and hazardous to human health and the environment.

Various solutions offering light emitting diode (LED) based fluorescent tube replacement lamps or other lighting devices have been proposed in U.S. Pat. Nos. 7,049,761, 7,114,830, 7,144,131 and 7,618,157, which are hereby incorporated by reference in their entirety. U.S. Pat. No. 7,049,761 describes fluorescent tube replacement lamps having a row of white LEDs directed towards the area of desired illumination. The LEDs appear as point sources along the length of the lamp, so light is harsh, not uniform or well distributed, and limited to the color quality and consistency of the LED sources. A refracting or scattering cover can be used to diffuse the light for a more uniform appearance, but this either adds significant cost (for a highly efficient diffuser) or loss of lamp efficiency. Furthermore, LEDs generate significant amounts of heat which reduces the lifetime and efficiency of the LED devices. In these lamps, the LED devices are enclosed in a tubular bulb, further increasing the operating temperature due to the large amount of trapped heat. Some lamps incorporate a horizontal heat sink, but such a heat sink, even with fins or grooves, is not very effective. U.S. Pat. No. 7,114,830 describes a fluorescent tube replacement lamp that has LEDs directed towards the area of desired illumination as described above, or directed towards a reflector. The reflector can be used to scatter light out of the lighting unit for a more uniform distribution of the light, however there will still be bright spots. The heat management problems are not addressed. Largely due to heat management issues, these proposed fluorescent tube replacement lamps will have reduced system efficacy, reduced lumen maintenance, problems with color consistency over lifetime, and uncertain reliability. U.S. Pat. No. 7,618,157 proposes a series of blue LEDs exciting a remote phosphor positioned on a plastic cover. Though this patent provides more uniform light, it requires a large amount of phosphor material to manufacture. Phosphor material can be extremely expensive, thus preventing achieving the cost goals required for adoption of this technology. Furthermore, though thermal issues are mitigated with the use of a remote phosphor, thermal management is not optimized and may result in reduced system efficacy, lumen maintenance issues, and uncertain reliability.

Therefore, a need exists for improved systems and methods of illumination. A further need exists for a lighting unit with improved thermal management and efficiency.

SUMMARY OF THE INVENTION

In accordance with an aspect of the invention, a lighting unit may be provided. The lighting unit may comprise at least one lighting strip, wherein each lighting strip comprises a support structure; a plurality of light emitting elements disposed along a length of said support structure; an at least partially reflective reflector extending substantially along said length; and a luminescent material disposed on said reflector, wherein said luminescent material is configured to be excited by at least a portion of the light emitted from at least one of said light emitting elements.

Another aspect of the invention may be directed to a lighting strip comprising a support structure; a plurality of light emitting elements disposed along a length of said support structure; a substantially non light-transmissive support extending substantially along said length; and a luminescent material disposed on said non light-transmissive support, wherein said luminescent material is configured to be excited by at least a portion of the light emitted from at least some of said light emitting elements.

Additionally, an aspect of the invention may include a lighting unit comprising a linear array of light emitting elements disposed along an axis; a heat sink in thermal communication with said light emitting elements; an axially extending primary reflector disposed proximate the linear array; an axially extending secondary reflector; and a phosphor disposed on the primary reflector or the secondary reflector or both the primary and secondary reflectors for modifying the optical properties of light derived from the light emitting elements, wherein the primary reflector is disposed to direct light incident thereon toward the secondary reflector and the secondary reflector is arranged to redirect light incident thereon.

A lighting strip may be provided in accordance with another aspect of the invention. The lighting strip may comprise a linear support structure; and at least partially reflective reflector extending substantially along the length of said support; and a plurality of open-air light emitting elements disposed along the length of said support structure, wherein light from said light emitting elements does not pass through secondary optics, and wherein the light from said light emitting elements is reflected at least once before leaving the lighting strip.

An additional aspect of the invention may be directed to a lighting unit comprising a heat dissipating support structure, having at least one space between portions of the support structure; a plurality of light emitting elements in thermal communication with the support structure and disposed along a length of said support structure; and at least one passageway located between at least two light emitting elements and through the heat dissipating support structure to the space.

In accordance with another aspect of the invention, a method of heat dissipation may be provided, comprising providing a heat dissipating support structure, having at least one space between portions of the support structure; providing a plurality of light emitting elements in thermal communication with the support structure and disposed along a length of said support structure; and transferring heat from the light emitting elements to the heat dissipating support structure and the at least one space between portions of the support structure, thereby creating a convection path through at least one space.

A lighting unit may be provided in accordance with an additional aspect of the invention. The lighting unit may comprise a heat dissipating support structure, having at least one space between portions of the support structure; a plurality of light emitting elements in thermal communication with the support structure and disposed along a length of said support structure; and at least one thermal conduit for dissipating heat from the lighting unit in fluid communication with at least one space.

Aspects of the invention may provide a novel lighting unit that avoids the problems of the prior art.

The invention may also provide a novel lighting unit having one or more lighting strips, each lighting strip having a heat dissipating support structure, a plurality of light emitting elements, and a base reflector with a luminescent material disposed thereon. The luminescent material is excited by at least some of the light emitting elements and emits light of a longer wavelength. The base reflector can be configured to direct light out of the lighting unit or to one or more optical elements that can be used to refract, reflect, and/or diffract the light to achieve a desired distribution of light.

The invention may further advantageously provide a novel lighting unit for replacing a conventional fluorescent tube lamp. The novel lighting unit includes two lighting strips, configured to electrically and mechanically couple with the receptacles in a conventional fluorescent lighting fixture. A substantially vacant space between the two lighting strips provides a convection path for removing heat from the light emitting elements. The two lighting strips can be mechanically coupled along their length, for example, by crossbars. Each lighting strip has a plurality of light emitting elements disposed along the length of a heat dissipating support structure and a base reflector with a luminescent material disposed thereon. The luminescent material is configured to be excited by at least some of the light emitting elements and emit light of a longer wavelength. The base reflector is can be configured to direct light to one or more optical elements that can be used to reflect, refract and/or diffract the light to achieve a desired distribution of light.

Aspects of the invention may provide a novel lighting unit for illumination that has at least one lighting strip with a plurality of light emitting elements directed towards a base reflector which then redirects the light to at least one optical element. The optical element can comprise a reflector, a refractor, a diffractor, or a combination thereof. The novel lighting unit may be configured to provide direct/indirect illumination. The novel lighting unit may or may not have a remotely disposed luminescent material.

Furthermore, the invention may provide a novel lighting unit having one or more lighting strips, each lighting strip having a heat dissipating support structure, a plurality of light emitting elements, and a luminescent support with a luminescent material disposed thereon. The luminescent material is excited by at least some of the light emitting elements and emits light of a longer wavelength. The luminescent support can be transparent or translucent. The lighting strip may further comprise at least one optical element to achieve a desired distribution of light.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF FIGURES

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

While preferable embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

The invention provides systems and methods for providing illumination. Various aspects of the invention described herein may be applied to any of the particular applications set forth below or for any other types of lighting units or lighting strips. The invention may be applied as a standalone system or method, or as part of an integrated illumination system. It shall be understood that different aspects of the invention can be appreciated individually, collectively, or in combination with each other.

Lighting Unit

An aspect of the invention relates to lighting units which may be used for illumination. A lighting unit may provide light suitable for general illumination. A lighting unit may be used as a replacement lamp for conventional lighting fixtures or as a standalone light source. A lighting unit may be used as a replacement for lighting fixtures of various types (e.g., fluorescent lighting fixtures, halogen lighting fixtures, incandescent lighting fixtures, gas discharge lamp, plasma lamp). Alternatively, the lighting unit is a unique lighting unit not intended to replace other lighting fixtures. A lighting unit may be highly efficient and may provide good quality light while having the potential to be manufactured at low cost.

The lighting unit may be used for general illumination or specialty lighting applications such as phototherapeutic applications, grow lighting, display lighting, architectural lighting, medical lighting, inspection lighting, decorative lighting, backlighting, signage, and other lighting applications. A lighting unit can be used for indirect or direct illumination, or a combination thereof. In some embodiments, the lighting unit may be provided for indoor applications. Alternatively, the lighting unit may be provided for the outdoors. The lighting unit can provide ambient or background light, or directed light. The lighting unit may be freestanding or portable, fixed (e.g., recessed, surface-mounted, outdoor), or for special purpose. In some implementations, the lighting unit may be provided for a ceiling, wall, or floor fixture. The lighting unit could be applied as a table lamp.

Replacement Lighting

As previously discussed, the lighting unit could be provided as a replacement for a conventional lighting fixture. Any description herein of replacing a particular type of conventional lighting fixture (e.g., fluorescent) can be applied to other types of conventional lighting fixtures.

Figure 1A:
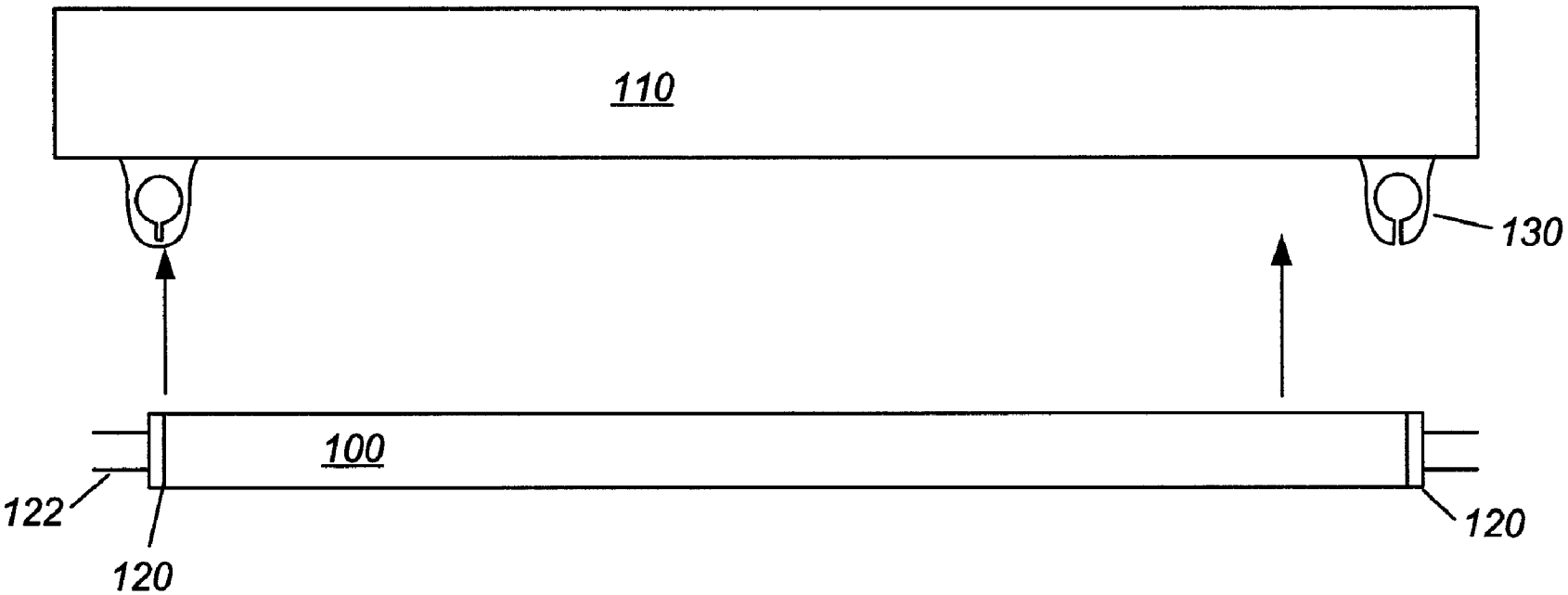
FIG. 1*a* is an environmental perspective view of a lighting unit and lighting fixture.

For example, as illustrated in FIG. 1*a*, the lighting unit 100 may be configured to replace a conventional fluorescent light tube in a conventional fluorescent lighting fixture 110. The replacement lighting unit 100 may be in a circular, linear, polygonal, curved, curvilinear u-shaped, or other form, depending upon which type of fluorescent light tube is to be replaced. Circular, u-shaped, linear, and other conventional fluorescent lamp shapes can be replaced with lighting units describe elsewhere herein. In one example, the lighting strips within a twin side emitter configuration as described herein can be u-shaped or circular for replacement of a u-shaped or circular fluorescent lamp. The lighting unit may be in a substantially tubular form to mimic the appearance of a conventional fluorescent light tube. Alternatively, the lighting unit may have an elongated form that is not necessarily tubular. The lighting unit may have a flattened elongated form. The lighting unit may or may not have the same overall shape as the light it is replacing.

The lighting unit may have a single end cap or multiple end caps, such as a pair of end caps 120 configured to mechanically and/or electrically couple the lighting unit 100 to a conventional fluorescent light receptacle 130. Alternatively, coupling can be achieved without end caps. Coupling may be achieved, for example, through the use of conductive pins 122 protruding from the end caps 120, as is used in conventional fluorescent light tube to receptacle coupling schemes. Each end cap may have one, two, or more conductive pins, or the electrical coupling can occur at one end cap having two or more conductive pins, for example. The pins may or may not be parallel. In one embodiment, least one of the end caps may be used only for mechanical coupling.

Figure 1B:
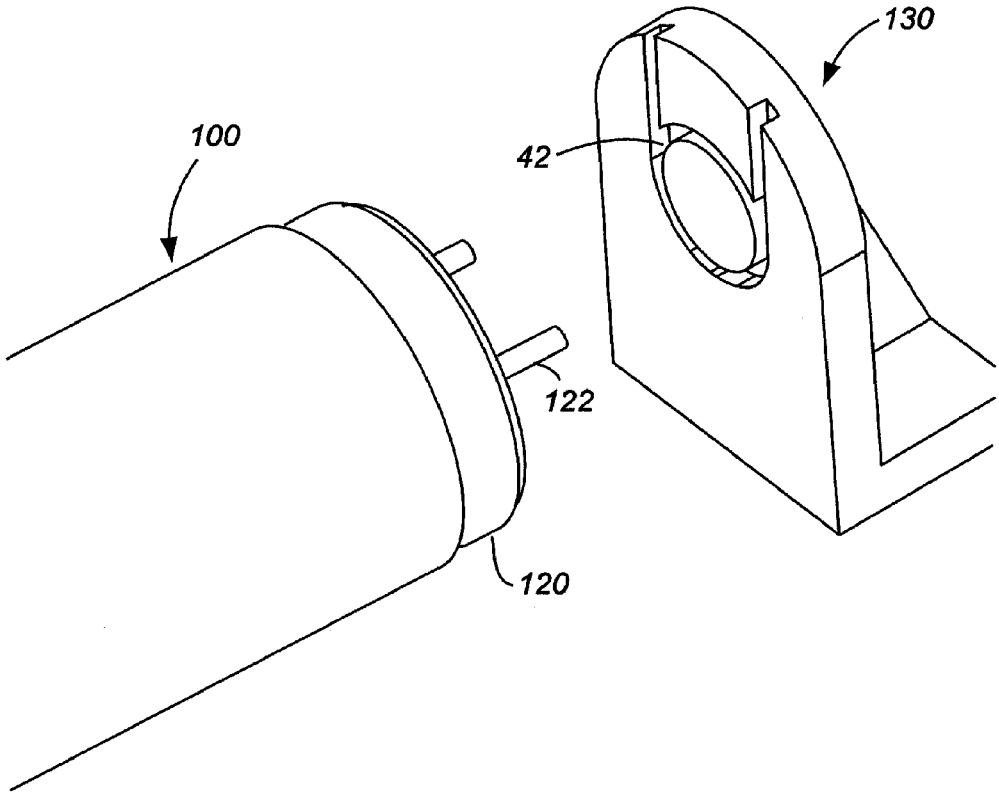
FIG. 1*b* is a view showing the installation of one embodiment of a lighting unit in a lighting fixture.

FIG. 1*b* is a fragmentary, perspective view showing one end of the lighting unit 100 having an end cap 120 with conductive pins 122 configured to electrically and mechanically couple to a receptacle 130 of the conventional fluorescent lighting fixture. In some embodiments, an end cap may have a pin or other connecting feature may be configured to electrically and/or mechanically with the lighting fixture. The pin or other connecting feature may or may not be formed from a conductive material. A lighting unit may be slid and/or twisted into a fixture. A lighting unit may be removably attached to a lighting fixture. Alternatively, the lighting unit is not removable from the lighting fixture.

Using the lighting unit in accordance with an embodiment of the invention as a fluorescent tube replacement lamp can have several advantages. The lighting unit can provide higher efficiency, thus decreasing the global amount of electricity used for lighting. In addition, such a lighting unit can provide reduced carbon dioxide emissions through the generation of electricity to power the light source and can eliminate the need for lamps containing mercury which poses risks to human health and the environment. It is estimated that two to four tons of mercury is produced annually in the U.S. from the 500 to 600 million fluorescent tubes discarded. Furthermore, higher quality light for an improved human visual experience can be provided. For example, the color and brightness can be independently tuned while maintaining high efficiency. Increased productivity can also result from improved quality of light. Furthermore, the lighting unit of the present work can be dimmable and easily installed.

Powering

The lighting unit may be configured to be powered by line alternating current or direct current. A power converting supply may be directly integrated into the lighting unit. A power source may be provided external or integrated into the lighting unit. A power source may use the grid/utility to power the lighting unit. For instance, light emitting elements of a lighting unit may be configured to be powered by a power supply. The power supply may be an external power supply. Alternatively, the power supply may be incorporated within the lighting unit. The power supply can be internal to the lighting unit. For example, the power supply can include a local energy storage system such as a battery, ultracapacitor, or induction coil.

The power supply may provide a drive condition which is a drive voltage or current appropriate to power at least some of the light emitting elements. The drive conditions can vary with time and can be programmed to change in response to feedback from a sensor or user input. The drive conditions may or may not be controlled by a control module, discussed in greater detail elsewhere herein.

Lighting Unit Configurations

A lighting unit may operate as a standalone light source and luminaire which may have a circular, linear, polygonal, curved, curvilinear, "x"-shape, "z"-shape, polyhedron, sphere, or other two-dimensional, or three-dimensional shape, for example. In other embodiments, the lighting unit may operate as a replacement lamp for use in other conventional luminaires. The lighting unit may have an elongated shape. In some embodiments, the elongated shape may be straight, curved, or bent.

The lighting unit may be provided as a solo illumination source. Alternatively, the lighting unit may be incorporated into a grouping or plurality of lighting units.

A lighting unit may have one, two, or more lighting strips. The lighting strip may be a light generating component of the lighting unit. A lighting strip may have a long, narrow array of light emitting elements. A lighting strip may have one or more row(s) of light emitting elements. A row of light emitting elements may be substantially straight, or may be curved or bent. The light emitting elements may be spaced to form an interrupted (dotted or dashed) line or a continuous line of light. The light emitting elements may be disposed with ample space between one another such that heat generated by the light emitting units can be optimally dissipated. Multiple lighting strips may be incorporated into a single lighting unit. The light emitting elements may be staggered perpendicular to the length of the array of light emitting elements. An array of light emitting elements may be curved or straight. One or more lighting strips of similar or varying lengths may be connected to one another at various angles to form other shapes or lighting unit geometries. For example, a "z", "x", "t", "y" or "v" shaped lighting unit or a polygonal lighting unit can be made with multiple lighting strips. Furthermore, three dimensional lighting units in shapes such as spheres or polyhedra can also be made. The light emitting elements of multiple lighting strips may be electrically connected.

Each lighting strip has a plurality of light emitting elements, generally disposed on a heat dissipating support structure. In many embodiments, the lighting strip may have an optical element, such as a base reflector, with a luminescent material disposed thereon. The lighting strip may also have one or more optical elements to aid in the distribution of light and/or to reduce glare.

Figure 2A:
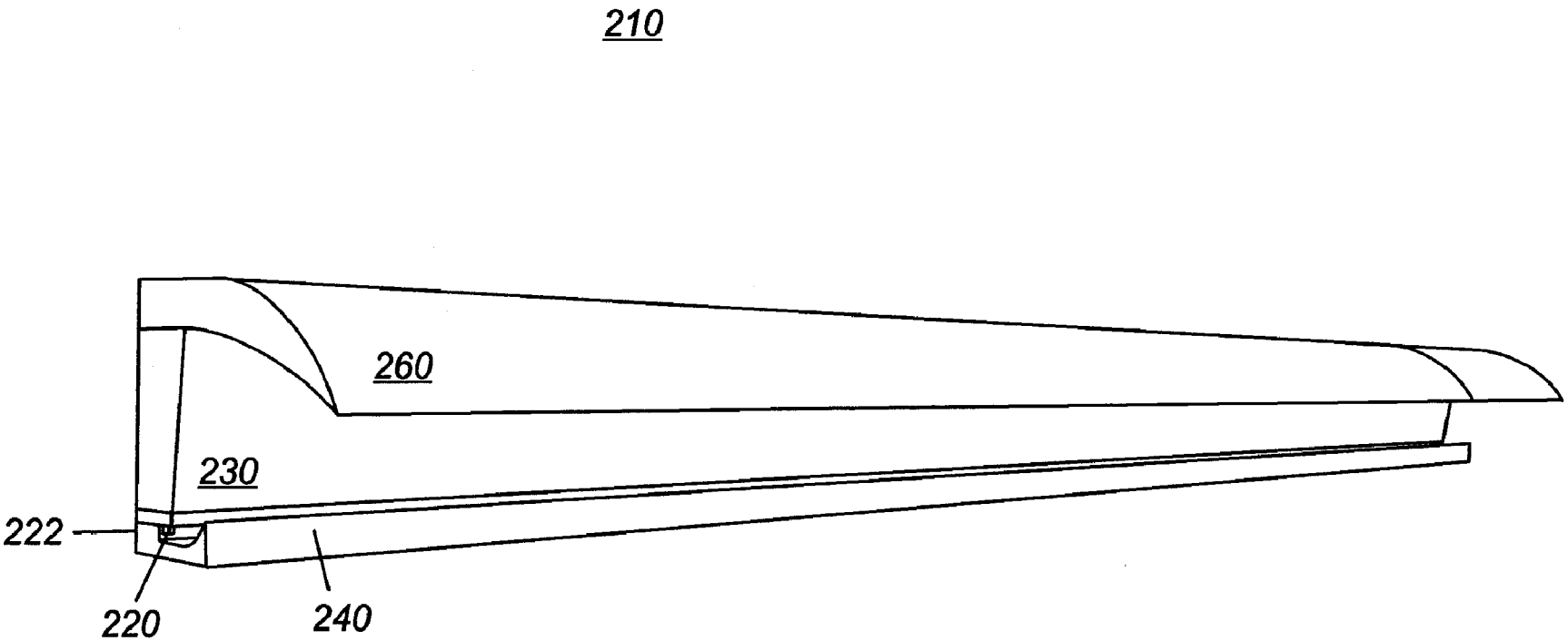
FIG. 2*a* is a fragmented perspective view of a lighting unit in accordance with an embodiment of the invention.
Figure 2B:
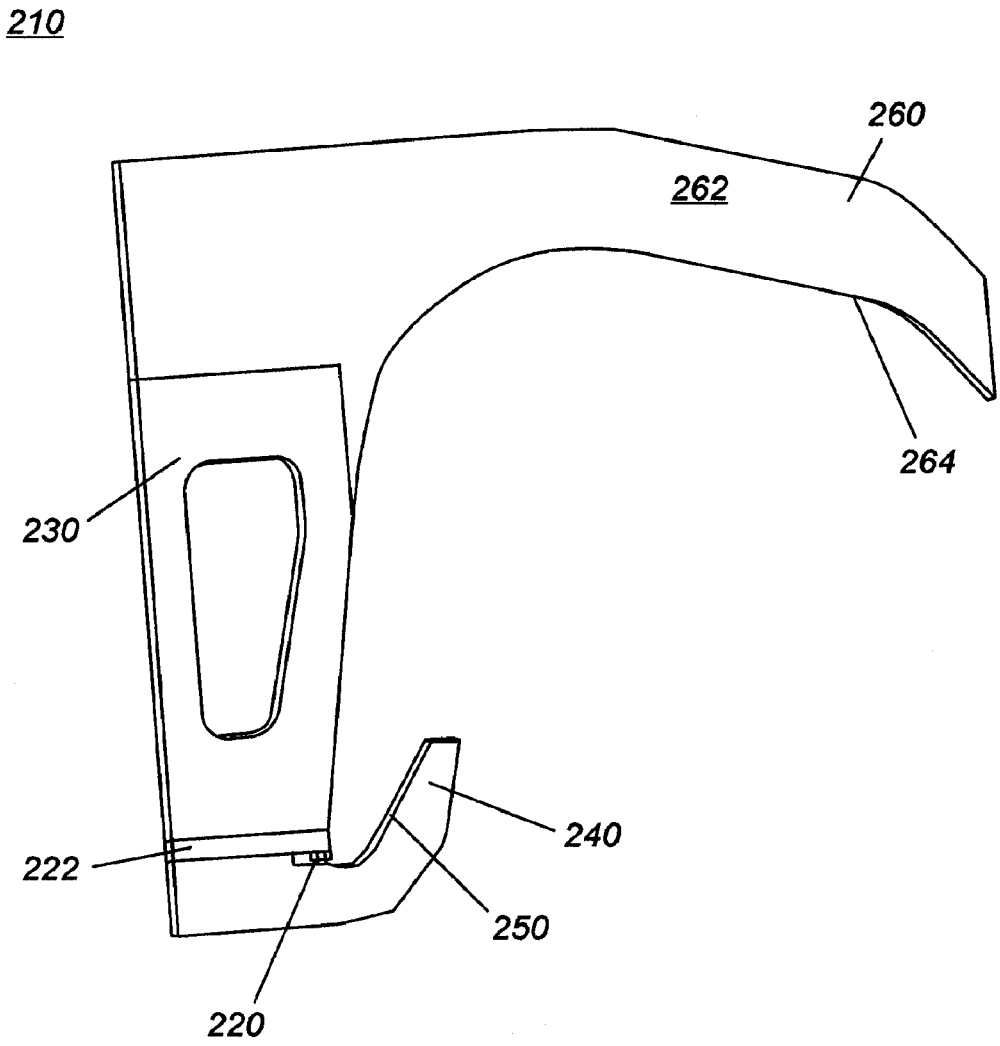
FIG. 2*b* is a cross-sectional view of a lighting unit with an optical element for light distribution, in accordance with an embodiment of the invention.

FIG. 2*a* shows a perspective view of a lighting unit in accordance with an embodiment of the invention. FIG. 2*b* shows a cross-sectional view of the lighting unit with a single lighting strip 210. The lighting strip 210 may have light emitting elements 220 mounted along the length of a heat sink 230. The light emitting elements may be side emitting light emitting diodes (LEDs) mounted on a circuit board 222. The light emitting elements (e.g., LEDs) may be positioned such that light generated by the light emitting elements is directed towards a base reflector 240. The base reflector 240 may have a luminescent material 250 disposed thereon. The base reflector 240 may direct light from the luminescent material 250 and light emitting elements 220 towards an optical element 260. The optical element 260 may distribute the light as desired.

Figure 3:
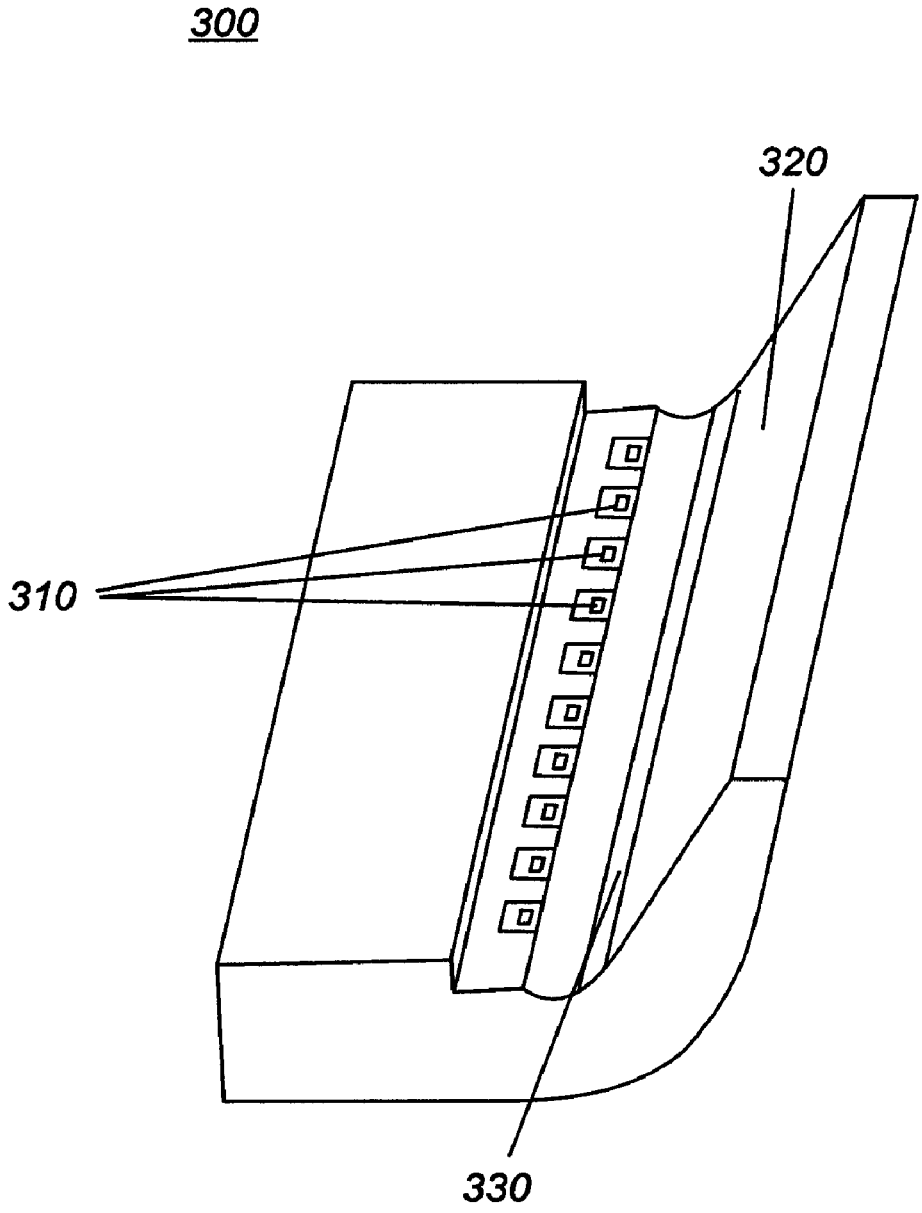
FIG. 3 is a fragmented perspective view showing placement of luminescent material and light emitting elements in a single lighting strip in accordance with an embodiment of the invention.

FIG. 3 shows a fragmentary, top view of a portion of a lighting strip 300 illustrating placement of the light emitting elements 310, the location of a base reflector 320, and the placement of a luminescent material 330 on the base reflector.

Lighting Unit Component Layouts

Figure 11:
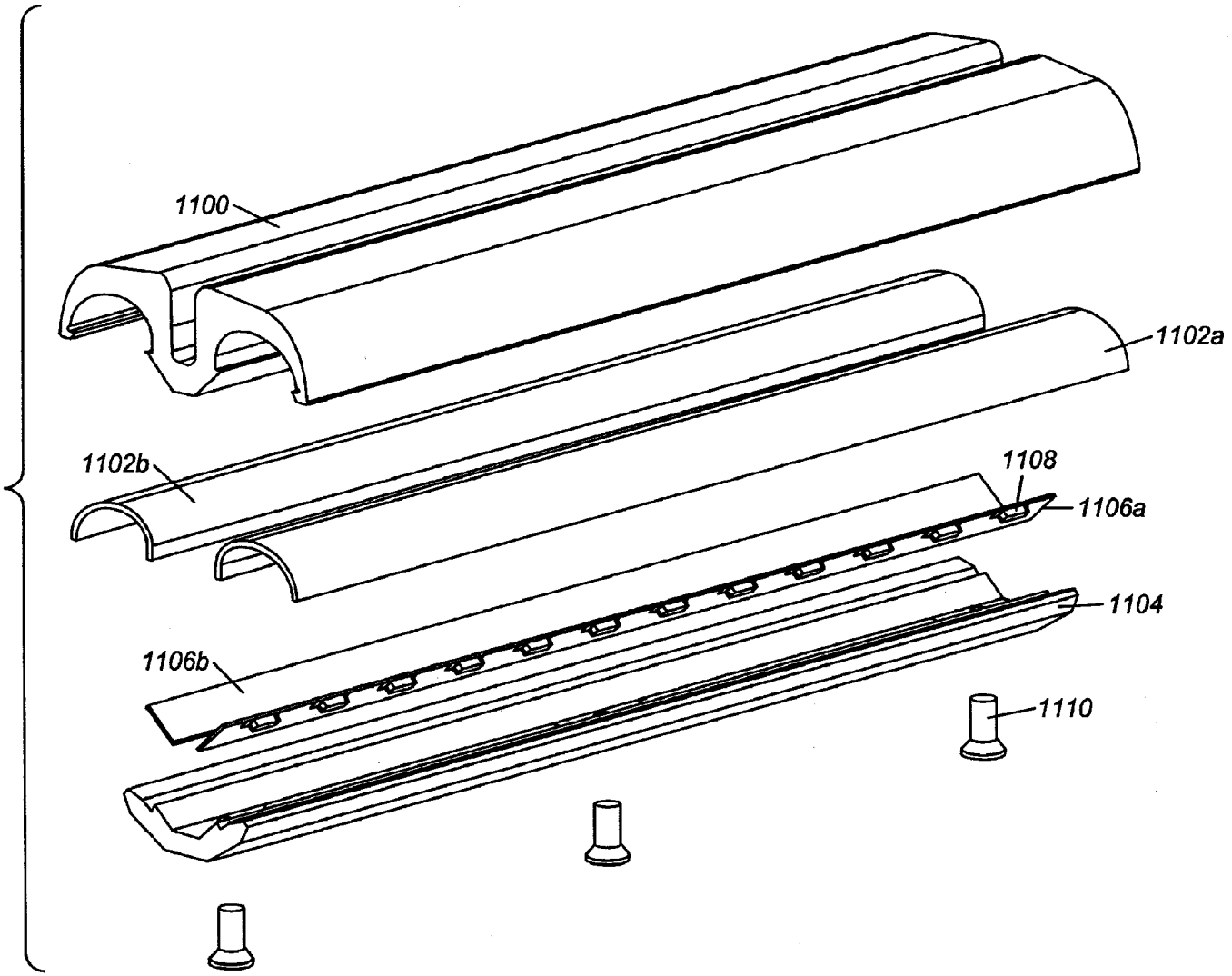
FIG. 11 shows an exploded view of a lighting unit in accordance with an embodiment of the invention. The lighting unit may have the orientation displayed or any other orientation. For example, the lighting unit may be inverted.

FIG. 11 shows an exploded view of a lighting unit in accordance with an embodiment of the invention. The lighting unit may have one or more of the following: one or more support structures 1100, one or more optical elements 1102*a*, 1102*b*, 1104, and one or more circuit boards 1106*a*, 1106*b* with at least one light emitting element 1108. In some embodiments, one or more fasteners 1110 may be provided.

A lighting unit may have a primary direction of illumination. As shown in FIG. 11, for example, the direction of illumination may be downward, wherein the side of the lighting unit accepting the fastener is a downward direction. Light may be emitted in multiple directions with a primary direction of illumination downward toward one or more fastener. For instance, light may be simultaneously emitted in a range of directions, while having a primary direction of illumination. Alternatively, a primary direction of illumination may be toward a side or upward relative to the fastener. In some embodiments, an upper surface or top of the lighting unit may be on a side opposite the direction of illumination and a lower surface or bottom of the lighting unit may be on the side in the direction of illumination. The lighting unit may be oriented in any manner with relation to its surroundings. The direction of illumination may be in any direction relative to the surroundings of the lighting unit. For example, the direction of illumination may be toward the ground or floor. In other examples, the direction of illumination may be toward a ceiling or sky, or sideways or toward a wall, or at any angle there between. In some examples, a lighting unit may have a primary direction of illumination downward relative to the lighting unit, which may or may not be downward relative to the surrounding environment.

In some embodiments, an optical element, such as the second optical element 1102*a*, 1102*b*, may be in contact or fitted to the support structure 1100. In some embodiments, the optical element may be complementary in shape to the support structure. For example, the support structure may have a curved shape extending lengthwise along the support structure, and the optical element may also include a complementary curved shape extending lengthwise along the optical element. The optical element may extend lengthwise along the support structure. The complementary curved shape of the optical element may allow the optical element to be fitted to the support structure. The optical element may be disposed on the surface of the support structure. In other embodiments, an optical element may be integrally formed with the support structure as a single unit. For example, the surface of the support structure may include a desired optical property as provided by the optical element.

A plurality of optical elements may contact the support structure 1100. For example, two second optical elements 1102*a*, 1102*b* may contact the support structure. The two second optical elements may be on the side of the support structure in the direction of illumination. In some embodiments, the two second optical elements may be provided on an underside of the support structure. A plurality of optical elements may contact a single continuous support structure. Alternatively, a plurality of optical elements may contact a plurality of support structures. The plurality of support structures may or may not be continuous with one another. In some instances, a single optical element may contact a single continuous support structure, or may contact a plurality of support structures that may or may not be continuous with one another.

In some embodiments, one or more circuit boards 1106*a*, 1106*b* may also contact a support structure 1100. A circuit board may or may not contact a second optical element 1102*a*, 1102*b*. A circuit board may be provided downward in the direction of illumination relative to the second optical element. In some embodiments, a circuit board may be located between two or more second optical elements or beneath a region between two or more second optical elements.

An optical element 1104 may contact one or more circuit board 1106*a*, 1106*b*. The optical element may or may not contact the support structure 1100. The optical element may extend lengthwise along the support structure. The optical element may be one or more first optical element 1104. The first optical element may be provided downward in the direction of illumination relative to the circuit board. The first optical element may be beneath the circuit board.

circuit Board

A lighting unit may include one or more circuit boards. The circuit board may be a printed circuit board (PCB). Any circuit board material known in the art may be used. One, two or more light emitting elements may be provided on a circuit board. Preferably, a plurality of light emitting elements are supported by a circuit board. The circuit board may also support and provide electrical connections to and/or between the light emitting elements. The circuit board may provide an electrical connection between one or more light emitting elements and a power source.

The circuit board may have any shape. For example, a circuit board may be shaped as a rectangle, square, triangle, circle, ellipse, pentagon, hexagon, octagon, u-shaped strip, bent strip, or straight strip. In some embodiments, the circuit board may have a length that is substantially longer than any other dimension of the circuit board (e.g., width, height). In some embodiments, the circuit board may have one or more sides. In some embodiments, the circuit board may have a straight side. In other embodiments, a side of a circuit board may be curved or may include protrusions or indentations. A circuit board may be flat and/or thin. A circuit board may be a rectangular strip.

A plurality of circuit boards may be provided for a lighting unit. In some embodiments, each of the circuit boards may have the same shape and/or size. Alternatively, the circuit boards may have varying shapes and/or sizes. The circuit boards may or may not contact one another.

In one example, two circuit boards may be provided, each with one or more light emitting element thereon. The circuit boards may be flat. The circuit boards may be elongated strips. The circuit boards may or may not be coplanar. The circuit boards may be arranged so that they are parallel to one another. Alternatively, the circuit boards may be angled relative to one another. In one embodiment, an axis extending lengthwise along a first circuit board through the center of the first circuit board may be parallel to an axis extending lengthwise along a second circuit board through the center of the second circuit board. The first and second circuit board may be rotated about the axes so that they are at non-parallel angles relative to one another. In one example, a plurality of circuit boards may be angled so that they form a "v" relative to one another. A gap may or may not be provided between the circuit boards.

Light Emitting Element

A circuit board may support one, two, three, four or more light emitting elements. A circuit board may support 20 or more, 50 or more, 70 or more, or 100 or more light emitting elements. In some embodiments, a circuit board may have electrical connections that may provide electrical connections between light emitting elements and a power source or between light emitting elements.

Each lighting unit may have a plurality of light emitting elements. In some implementations each lighting strip has a plurality of light emitting elements. Each circuit board may support at least one lighting element. The light emitting elements may be any illumination source known in the art. For example, the light emitting elements may include a light emitting diode (LED). A light emitting element may include an LED package. A light emitting element may be a phosphor converted LED. The light emitting element may comprise an LED chip and an encapsulant and/or other lenses or reflectors that function as a primary optics. In some embodiments, a light emitting element may comprise a phosphor proximate the LED chip configured to convert a portion of the light emitted by the LED chip to a longer wavelength. Alternatively, the light emitting element need not have a phosphor coated thereon. A light emitting element can be formed of a semiconductor material with a primary optic. In some embodiments, a light emitting element may be a point source or substantially point source light emitting element.

In some embodiments, a light emitting element may be a side emitting LED. In other embodiments, a light emitting element may be a top emitting LED or a bottom emitting LED. The light emitting element may direct light in any or multiple directions.

The light emitting elements may be cold cathode fluorescent lamps (CCFLs) or electroluminescent devices (EL devices). Cold cathode fluorescent lamps may be of the type used for backlighting liquid crystal displays and are described generally in Henry A. Miller, Cold Cathode Fluorescent Lighting, Chemical Publishing Co. (1949) and Shunsuke Kobayashi, LCD Backlights (Wiley Series in Display Technology), Wiley (Jun. 15, 2009), which are hereby incorporated by reference in their entirety. EL devices include high field EL devices, conventional inorganic semiconductor diode devices such as LEDs, or laser diodes, as well as OLEDs (with or without a dopant in the active layer). A dopant refers to a dopant atom (generally a metal) as well as metal complexes and metal-organic compounds as an impurity within the active layer of an EL device. Some of the organic-based EL device layers may not contain dopants. The term EL device excludes incandescent lamps, fluorescent lamps, and electric arcs. EL devices can be categorized as high field EL devices or diode devices and can further be categorized as area emitting EL devices and point source EL devices. Area emitting EL devices include high field EL devices and area emitting OLEDs. Point source devices include inorganic LEDs and edge- or side-emitting OLED or LED devices. High field EL devices and applications are generally described in Yoshimasa Ono, Electroluminescent Displays, World Scientific Publishing Company (June 1995), D. R. Vij, Handbook of Electroluminescent Materials, Taylor & Francis (February 2004), and Seizo Miyata, Organic Electroluminescent Materials and Devices, CRC (July 1997), which are hereby incorporated by reference in their entirety. LED devices and applications are generally described in E. Fred Schubert, Light Emitting Diodes, Cambridge University Press (Jun. 9, 2003). OLED devices, materials, and applications are generally described in Kraft et al., Angew. Chem. Int. Ed., 1998, 37, 402-428, and Z., Li and H. Meng, Organic Light-Emitting Materials and Devices (Optical Science and Engineering Series), CRC Taylor & Francis (Sep. 12, 2006), which are hereby incorporated by reference in their entirety.

The light emitting elements can produce light in the visible range (e.g., 380 to 700 nm), the ultraviolet range (e.g., UVA: 315 to 400 nm; UVB: 280 to 315 nm), and/or near infrared light (e.g., 700 to 1000 nm). Visible light may correspond to a wavelength range of approximately 380 to 700 nanometers (nm) and is usually described as a color range of violet through red. The human eye is not capable of seeing radiation with wavelengths substantially outside this visible spectrum such as in the ultraviolet or infrared range, but these wavelengths may be useful for applications other than lighting, such as phototherapy or inspection applications. Furthermore, ultraviolet light may be down converted by a luminescent material in the lighting strip. The visible spectrum from shortest to longest wavelength is generally described as violet (approximately 400 to 450 nm), blue (approximately 450 to 490 nm), green (approximately 490 to 560 nm), yellow (approximately 560 to 590 nm), orange (approximately 590 to 620 nm), and red (approximately 620 to 700 nm). White light is a mixture of colors of the visible spectrum that yields a human perception of substantially white light. The light emitting elements can produce a colored light or a visually substantially white light. Various light emitting elements can emit light of a plurality of wavelengths and their emission peaks can be very broad or narrow. In one example, the emission peaks may be greater than, less than, or equal to about 100 nm, 50 nm, 30 nm, 20 nm, 15 nm, 10 nm, 5 nm, or 1 nm. In some examples, the entire wavelength emission range may be greater than, less than, or equal to about 500 nm, 400 nm, 300 nm, 200 nm, 150 nm, 100 nm, 50 nm, 30 nm, 20 nm, 15 nm, 10 nm, 5 nm, or 1 nm. Light emitting elements may be white LEDs or blue LEDs for example. Furthermore, in a single lighting unit, light emitting elements may comprise a combination of colors such as red and white LEDs or red, green and blue LEDs.

A lighting unit may include light emitting elements that all emit wavelengths within the same range. Alternatively, light emitting elements that emit light in different wavelengths may be used. For example, a circuit board may support one or more color of LEDs.

In some embodiments, it may be desirable for a lighting unit to include both white and red LEDs. In some embodiments, a combination of LEDs may be used to form a white light. In some embodiments, one or more cool white LEDs and one or more red LEDs (e.g., having a wavelength in the range of about 620 to 700 nm) may be provided on a lighting unit. In another embodiment, one or more mint green or greenish white LEDs and one or more red LEDs (e.g., having a wavelength in the range of about 620 to 700 nm) may be provided on a lighting unit. The LEDs having different wavelengths may be alternatingly positioned on the lighting unit. For example, white and red LEDS, or green and red LEDs may be alternatingly positioned along an edge of a circuit board. In other embodiments, groups of white and red LEDS or groups of green and red LEDs may be alternatingly located along an edge of a circuit board. In some embodiments, a lighting unit may include both blue and red LEDs, or blue, white, and red LEDs. In some embodiments, the proportion of white LEDs to red LEDs may be greater than, less than, or equal to about 20:1, 15:1, 10:1, 7:1, 5:1, 3:1, 2:1, 1:1, 1:2, 1:3, 1:5, or 1:10. The color and proportion of different groups of LEDs may be configured to achieve a desired correlated color temperature (CCT), Duv, color rendering index (CRI), color quality scale (CQS), or other color specifications that may be required to meet Energy Star requirements, for example. Different groups of LEDs may be driven separately to preserve color over lifetime and temperature. Furthermore, separately driving different groups of LEDs may allow color tuning and dimming features. Groups of light emitting elements may or may not comprise light emitting elements of the same color.

Any combination of light emitting elements, such as the LEDs described herein, may or may not be used in combination with a remote luminescent material as described in further detail elsewhere herein. A remote luminescent material may receive light emitted from a white LED and light emitted from a red LED. The remote luminescent material may receive light emitted from both a white LED and red LED at the same region of the luminescent material. Alternatively, the remote luminescent material may be positioned to receive light primarily from certain light emitting elements or groups of light emitting elements, but not others. The luminescent material may or may not emit light with a longer wavelength, shorter wavelength, or the same wavelength as the light emitted from the LEDs incident upon the luminescent material.

Light emitting elements known in the art may be used in combination with one or more features of the lighting unit. See, e.g., U.S. Patent Publication No. 2008/0130285; U.S. Pat. No. 6,692,136; U.S. Pat. No. 6,513,949; U.S. Patent Publication No. 2009/0296384; U.S. Pat. No. 7,213,940; or U.S. Pat. No. 6,577,073, which is hereby incorporated by reference in their entirety.

Light Emitting Element Configuration on Circuit Board

The light emitting elements may be mounted on at least one circuit board or may be mounted directly on a support structure and may be electrically connected to one another. For instance, light emitting elements may be connected to one another in series, in parallel, or in any combination thereof. Alternatively, the light emitting elements need not be electrically connected to one another and may be individually connected to a power source. Groups of light emitting elements may permit the light emitting elements within the groups to be in electrical communication with one another without being in electrical communication with light emitting elements of other groups. The light emitting elements are configured to be powered by a power supply. The power supply may be an external power supply. Alternatively, the power supply may be incorporated within the lighting unit. The power supply may provide a drive condition which is a drive voltage or current appropriate to power at least some of the light emitting elements. The drive conditions can vary with time and can be programmed to change in response to feedback from a sensor or user input.

The light emitting elements may be located along one or more edges of a circuit board. The light emitting elements may be located on a lower surface of the circuit board or an upper surface of the circuit board. The light emitting elements may be located on a side of the circuit board facing a first optical element or may be located on a side of the circuit board facing the support structure.

The light emitting elements may have a linear arrangement on a circuit board. In one embodiment, light emitting elements may be provided along one edge of the circuit board. The edge may be a long edge of the circuit board. A lighting unit may have a plurality of circuit boards, wherein the light emitting elements are supported along one edge of each circuit board. In some instances, the light emitting elements may be along the edges of the circuit board that are opposite the side of the circuit board closest to another circuit board. For example, if two circuit boards are provided so that their cross section forms a rough "v" shape, the light emitting elements may be located at the top part of the "v". The light emitting elements may form rows (e.g., on different circuit boards) that are substantially parallel to one another. The light emitting elements may form an axial arrangement. The axial arrangement may be parallel to an axis extending lengthwise along the circuit board and/or the lighting unit.

A circuit board may have an upper surface facing upwards and a lower surface facing downwards. The light emitting elements may be on an upper surface of a circuit board or on a lower surface of the circuit board.

In another example, a first axial arrangement of light emitting elements may be provided along one edge of the circuit board, and a second axial arrangement of light emitting elements may be provided along a second opposing edge of the circuit board. The first and second axial arrangements may be substantially parallel to one another. The light emitting elements may be at or near an edge of the circuit board. Alternatively the light emitting elements need not be at or near the edge of the circuit board. The light emitting elements may or may not be at or near an edge of the circuit board for any shape of the circuit board.

One or more rows of light emitting elements may be provided on a circuit board. The one or more rows of light emitting elements may be parallel to an edge of the circuit board. The row of light emitting elements may be parallel to a lengthwise edge of the circuit board. In some embodiments, an array (having one or more rows, or one or more columns) of light emitting elements may be provided on a circuit board. The light emitting elements may be disposed on the circuit board with a staggered design, concentric design, or randomly.

In some embodiments, the light emitting elements may be disposed at or near an edge of a circuit board that may be curved or have any other shape.

FIG. 11 is an example of a circuit board 1106*a* with light emitting elements 1108. The light emitting element can be an LED package or any other light emitting element described elsewhere herein. A circuit board may be formed as a rectangular strip with a first edge extending lengthwise along the circuit board and a second opposing edge extending lengthwise along the circuit board. The first and second edges may be substantially parallel to one another. One, two, or more light emitting elements may be positioned along the first edge. Zero, one, two, or more light emitting elements may or may not be positioned along the second edge.

In some embodiments, the light emitting elements may be positioned along only one edge of the circuit board.

Alternatively, the light emitting elements may or may not be positioned at or near the edge of the circuit board. In some instances, the light emitting elements may be located at the center of the circuit board, or the circuit board may have some exposed surface between the LED and the edge of the circuit board.

In other embodiments, the light emitting elements are positioned symmetrically about an axis extending lengthwise along the circuit board through the center of the circuit board. When traveling along the length of the circuit board, a light emitting element may be positioned on a first edge and second edge along the same length of the circuit board. Alternatively, the light emitting elements may have a staggered configuration so when traveling along the length of the circuit board, a light emitting element may be positioned on a first edge without being positioned along a second edge and vice versa along the circuit board (e.g., alternating positions between first and second edge).

The light emitting elements may or may not be substantially evenly spaced along the first edge. The light emitting elements may or may not be substantially evenly spaced along the second edge. In some instances, the light emitting elements may be randomly positioned on the first and second edges. The light emitting elements may be positioned along the entire length of the circuit board, or may be positioned along portions of the length of the circuit board.

The light emitting elements may be spaced along an edge of the circuit board so that some edge of the circuit board is provided between the light emitting elements. The light emitting elements can be spaced apart so that the edge between the light emitting elements has a greater length than the edge directly beneath the light emitting elements, lesser length than the edge directly beneath the light emitting elements, or about the same length as the edge directly beneath the light emitting elements. In some embodiments, the gap between light emitting elements may be greater than, less than, or equal to about 10%, 20%, 30%, 40%, 50%, 60%, 70%, 80%, 90%, 100%, 110%, 120%, 130%, 150%, 175%, 200%, 250%, 300%, 350%, 400% or 500% the length of the light emitting element.

The light emitting element may be attached to a circuit board by any method known in the art including, but not limited to, soldering (e.g., eutectic soldering), brazing, adhesive, mechanical fastener, or clamp.

The light emitting element may emit light in multiple directions. A light emitting element may emit light in multiple directions with portions of the light being blocked by the circuit board. Light from a light emitting element may simultaneously directly reach a support structure or second optical element and first optical element.

A gap may be provided between a plurality of circuit boards. For example, a circuit board may have gap configured to allow a fastener to pass through. Alternatively a passageway may be provided within one or more circuit board. One, two, three, four, or more passages may be provided. A passageway of the circuit board or the gap between circuit boards may permit the flow of air or other fluid through the lighting unit. The passageway may advantageously permit the formation of a convection path that may cool the lighting unit.

Optical Elements

A lighting unit may include one or more optical element. In some embodiments, a lighting unit may have a first optical element and a second optical element. The first optical element and the second optical element may or may not have different properties. In some embodiments, multiple optical elements may be provided which may share the same or similar features. Any description herein of the first optical element may apply to the second optical element, and vice versa. In some embodiments, the lighting unit may have a first optical element as described herein without having a second optical element. Alternatively, the lighting unit may have an optical element having characteristics of the second optical element described herein without having an optical element with characteristics of the first optical element. The lighting unit may have any number of optical elements (e.g., 1, 2, 3, 4, 5, 6, 7, 8, 9, 10 or more optical elements).

The designation of first, second, third, etc. optical element does not necessarily designate the order in which light is configured to be received by the optical elements. For instance, light from the light emitting elements may be simultaneously received by the first and second optical elements. Furthermore, the first and second optical elements may simultaneously direct light out of the lighting unit and toward any optical element (including the first and second optical element).

The optical elements may be configured to provide a desired light distribution. For example, the shape, angle and optical properties of first and second optical elements may be configured such that the standalone lighting unit provides a "batwing" light distribution or other light distribution that is similar to that of a conventional fluorescent tube mounted in a parabolic or other conventional troffer. Alternatively, the optical elements of the lighting unit may be configured such that when the lighting unit is mounted in a parabolic troffer, the light distribution profile matches that of a conventional fluorescent tube mounted in parabolic or other conventional troffer. Alternatively, the optical elements may be configured to provide a concentrated or narrow beam light distribution, or a lambertion emission profile. The ability to tune the beam angle and light distribution using the optical elements is an advantageous feature of this design. Currently available fluorescent tube replacement products have light distribution profiles that do not match that of conventional fluorescent tubes mounted in conventional troffers. The light intensity provided by currently available fluorescent tube replacement lamps at high angles is much less than that of conventional fluorescent tubes in conventional troffers. Thus, for example, to preserve the light distribution profile and uniform intensity across the illuminated floor space, additional troffers would need to be installed if using currently available fluorescent tube replacements lamps.

A lighting unit may have at least one first optical element and at least one second optical element. In some embodiments, a first optical element may be located closer to a light source than the second optical element. The first optical element may be proximately located relative to the light emitting elements. In other embodiments, a first optical element may be located downward relative to the second optical element. In some embodiments, emitted light may reach a first optical element before reaching a second optical element. The first optical element may direct light to the second optical element, and vice versa.

In some embodiments, a light emitting element may have primary optics, such as a portion of an LED package. A lighting unit may have one or more secondary optics external to the light emitting element. Secondary optics may shape the light output from a light emitting element. The first or second optical element described herein may be a secondary optic. For instance, a light emitting element may comprise a light emitting device and primary optics. For example, a light emitting diode package may comprise a chip and primary optics such as a lens and/or reflectors within the package. There may be 0, 1, 2, 3, 4, or more additional optical elements, which may serve as secondary optics. A cover, as discussed elsewhere herein, may optionally be a secondary optic. Alternatively, no secondary optics may be provided in the lighting unit. In some embodiments, light emitted from a light emitting element does not pass through secondary optics.

First Optical Element

A lighting unit may have a first optical element. In one example the first optical element may be a base reflector. FIG. 2*b* shows an example of a base reflector 240. FIG. 11 shows another example of a first optical element 1104. The first optical element may be a reflector positioned at or near the bottom of a lighting unit. The first optical element may be disposed downward of the light emitting element. The first optical element may be a reflective lower light blocker. The first optical element may be a light source-proximate reflector.

The first optical element may have one or more hooked or curved portion that may be directed upward. The hooked or curved portion may be on one or more side of the first optical element. In one embodiment, the first optical element may have a first upward directed ridge on a first side of the first optical element and a second upward directed ridge on a second opposing side of the first optical element. The ridges may extend lengthwise along the first optical element. The ridge may or may not have one or more shelves. The ridge may or may not have a faceted shape. The first optical element may block and prevent light from directly leaving the lighting strip.

In one embodiment, the first optical element may have a central channel or groove. The central channel or groove may be provided along the length of the first optical element. The central channel or groove may have a trapezoidal cross-section. The central channel or groove may be on an upper surface of the first optical element facing the support structure. The first optical element may or may not directly contact the support structure along the central channel or groove. The first optical element may or may not support one or more circuit board along the central channel or groove. In one example, two or more circuit boards 1106*a*, 1106*b* may be supported by angled sides of a central groove of a first optical element 1104.

The first optical element may have a reflective component. The first optical element may have a smooth, reflective surface. The first optical element may be formed of, or may include, metal, plastic, glass, or any other material. In one example, a metal or plastic surface may be disposed on a supporting structure. For example, the first optical element may be a base reflector which can comprise a reflective strip of tape disposed on a support, or a metallic layer evaporated onto a support. The base reflector may be a polished surface of a metallic piece. In another example, the first optical element may be formed of a plastic with a specular or diffuse reflective surface.

The first optical element may be at least partially reflective. The first optical element may have one or more regions that are reflective. The first optical element may be entirely reflective. The first optical element may have one or more regions that are not reflective or only partially reflective. In some embodiments, the first optical element does not transmit light. The first optical element may be non-light transmissive. In some implementations, the first optical element does not transmit light directly through the optical element. Alternatively, portions of the first optical element may transmit light. In one embodiment, the first optical element is partially reflective and partially transmissive, allowing light to transmit through and reflect from the first optical element. In some embodiments, the optical element may have greater than, less than, or equal to about 10%, 30%, 50%, 70%, 80%, 90%, 95%, 97%, 98%, 99%, 99.5%, or 99.9% reflectivity.

The first optical element may be opaque, translucent, or transparent. The first optical element may have any color including, but not limited to, white, black, red, blue, green, or yellow.

The surface of the first optical element may be smooth, or may be rough. The surface of the optical element may be flat, curved, or have protruding or recessed features.

The first optical element may include portions that may be used for light reflectance, light refraction, and/or light diffraction. The first optical element may have a diffuser, a lens, a mirror, optical coatings, dichroic coatings, grating, textured surface, photonic crystal, or a microlens array. The first optical element may be any reflective, refractive, or diffractive component, or any combination of reflective, refractive, or diffractive components. For instance, the first optical element may be both reflective and refractive. For example, a transparent optical element may be used which reflects light off of a light receiving surface of the optical element and refracts light passing through the optical element. Light reflection off the receiving surface can be enhanced, for example, by deposition of a thin, semi-transparent metallic layer. Light refraction through the first optical element may be dependent on the index of refraction of the selected material and could be enhanced by an anti-reflective coating on the receiving surface of the first optical element. The balance of reflection and refraction can be tuned through the use of various optical coatings on the receiving surface of the first optical element. Another example of a reflective and refractive optical element is a transparent optical element with mirrors spatially distributed on the receiving surface.

A reflective and refractive optical element may be advantageous for providing direct and indirect lighting. For example, with direct/indirect lighting, the lighting unit can emit light both "up" to the ceiling and "down" to the workspace. The optical element may reflect light "down" and refract light "up" or vice versa. With direct and indirect lighting, the lighting unit can simultaneously emit light "down" to directly illuminate the workspace and "up" to be reflected or scattered off of other surfaces such as ceilings and walls to provide indirect lighting. Thus, a good balance between ambient illumination of the room and accent lighting at good energy efficiency can be achieved, even in large spaces. Some indirect lighting may be desirable in many applications. Traditional fluorescent tube replacement lamps do not provide simultaneous direct and indirect lighting. Reflective glare on surfaces such as computer screens may be reduced with indirect lighting, and three dimensional objects are rendered well without harsh shadows with indirect lighting. Another example of achieving direct/indirect lighting with the present work is to have a reflective optical element with holes or cutouts. Such an optical element can reflect a portion of the light "down" to the workspace, for example, as direct lighting from the lighting unit. Another portion of light will be transmitted "up" through the holes or cutouts in the optical reflector, to illuminate the ceiling, for example, and provide indirect lighting from the lighting unit. In these examples, the percentage of light emitted by the lighting unit as indirect lighting can be tuned from 0%-100% by varying the features of the optical elements. Directional "up" and "down" references are used herein only as examples and other configurations and orientations of the lighting unit and light emission are possible. The primary directions of light emission for direct and indirect light are not necessarily 180 degrees apart.

Reflective optical elements can be specular reflective material, diffuse reflective material, or any combination thereof. Diffuse reflective optical elements can further aid in broadening the distribution of light.

Refractive optical elements can be diffusers to aid in providing a more uniform light distribution.

Figure 10B:
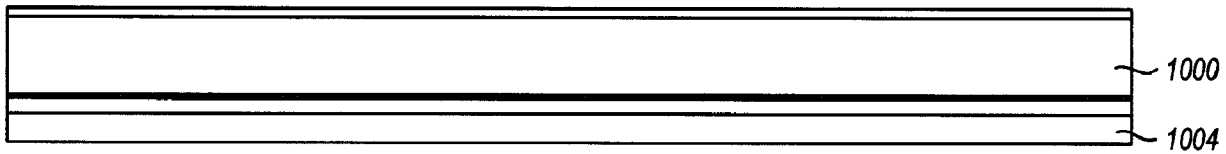
FIG. 10*b* shows a side view of a lighting unit in accordance with an embodiment of the invention.
Figure 10A:
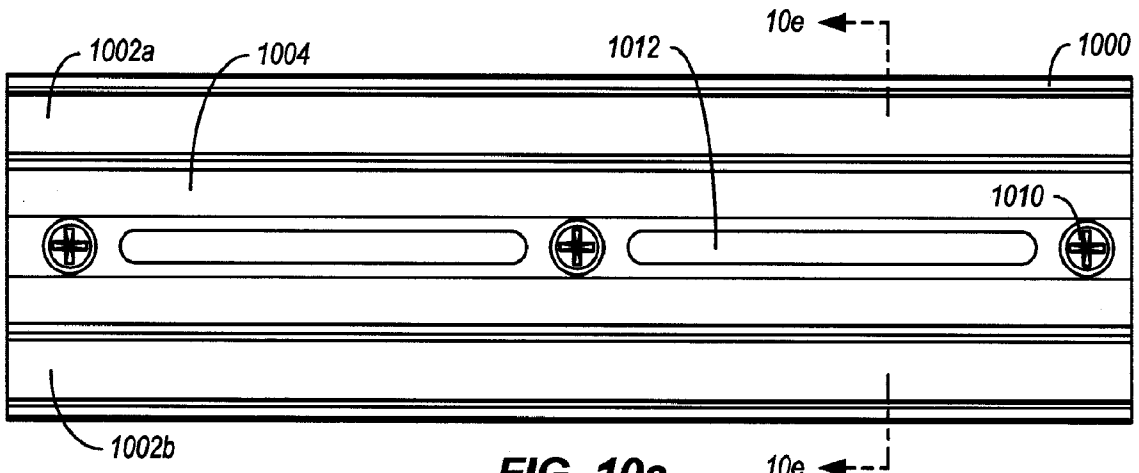
FIG. 10*a* shows a bottom view of a lighting unit in accordance with an embodiment of the invention.

A first optical element may have one or more passageways. FIG. 10A shows an example of one or more passageway 1012 that may be provided in a first optical element. An optical element may have one, two, three, four, or more fasteners 1010 passing through. One, two, three, four, or more passages 1012 may be provided. A passageway of the optical element may permit the flow of air or other fluid through the lighting unit. This may permit the formation of a convection path, which may be discussed in greater detail elsewhere herein. In some embodiments, the passageway may have an elongated shape. The passageway may optionally have a cross-sectional area greater than, or equal to about 3%, 5%, 7%, 10%, 12%, 15%, 20%, 25%, 30%, or 50% of the optical element. The passageway may have a width greater than, or equal to about 0.5 mm, 1 mm, 1.5 mm, 2 mm, 2.5 mm, 3 mm, 4 mm, 5 mm, 6 mm, 7 mm 8 mm, 9 mm, 10 mm, 12 mm, 15 mm, or 20 mm. In some instances, the width:length ratio of the passageway may be about 1:20, 1:15, 1:10, 1:7, 1:5, 1:4, 1:3, 1:2, or 1:1. The passageway may advantageously permit the formation of a convection path that may cool the lighting unit. In some embodiments, the position of a fastener and passageway may alternate when traveling lengthwise along the optical element. In some implementations, an optical element may have N fasteners and N−1 passageways, where N is a positive whole number.

The first optical element may be formed of a single integral piece. For example, the optical element can be formed of a single reflective material. Alternatively, the first optical element may be formed of a plurality of pieces. A plurality of pieces may be removably or permanently connected.

Second Optical Element

The lighting strip may have one or more second optical elements. In some embodiments, the second optical element may distribute light in a region or regions of desired illumination.

The second optical elements may be light reflecting components, light refracting components, light diffracting components, or a combination thereof. The optical element may have a diffuser, a lens, a mirror, optical coatings, dichroic coatings, grating, textured surface, photonic crystal, or a microlens array, for example. The second optical element may have on one or more feature as previously described for the first optical element. Any description herein of the first optical element may also apply to the second optical element, and vice versa. For example, the second optical element may or may not be fully or partially reflective. In another example, the second optical element may or may not permit the transmission of light through the second optical element. In another example, the second optical element may comprise cutouts or holes to allow light transmission through the optical element.

The shape of the second optical element can define the distribution of light from the lighting unit. Additionally, the curvature or mounting angle of the second optical element with respect to the position of the base reflector and light emitting elements can define the distribution of light from the lighting unit. In some embodiments, the second optical element may be shaped to reduce glare. In some embodiments, the second optical element may be shaped to provide a diffuse light from the lighting unit. In another example, the second optical element may be shaped to provide focused light from the lighting unit. The second optical element may cause light to diverge or be distributed over a wide area. Alternatively, the second optical element may cause light to converge or be distributed over a small area. The second optical element may direct light in a primary direction, e.g., downwards, sideways, or upwards. In other embodiments, light may be distributed in many directions without requiring a primary direction. For example, light may be distributed downwards and sideways, downwards and upwards, upwards and sideways, or any other combination of directions.

In some embodiments, the second optical element may have one or more flat surface, or one or more curved surface.

The second optical element may be curved. In one example, the second optical element may be curved about an axis extending lengthwise along the optical element. In some embodiments, the second optical element may have only one radius of curvature. Alternatively, the second optical element may have zero, one, two, three, or more radii of curvature. A plurality of curvatures may or may not be provided in different directions. The second optical element may have a concave side and a convex side. The concave side may be directed downwards in a primary direction of illumination. The concave side may face opposite a support structure. A convex side of the optical element may face a support.

In some embodiments, the second optical element may be attached to, affixed to, or may contact a support structure. Alternatively, the second optical element may be integrally formed with the support structure. The second optical element may be formed of a single piece with the support structure. The second optical element may be permanently affixed to the support structure. Alternatively, the second optical element may be movable or removable relative to the support structure. In some embodiments, the support structure may have a lip or shelf that may retain the second optical element. In some embodiments, the support structure may be a heat-dissipating support structure. The support structure may be described in greater detail elsewhere herein.

In one example, in the lighting strip 210 in FIG. 2*b*, the second optical element 260 can be a reflective optical element. The reflective optical element can be made of a plastic support 262 with a thin, reflective aluminum coating 264 evaporated onto the first optical surface that is the side of the plastic support facing the base reflector 240. The curvature of the optical element 260 can be configured to provide a broad distribution of light. Rather than a continuous reflective coating, the optical element can comprise reflective regions on the interior surface of the optical element. Furthermore, the optical element can be an extension of the heat sink support, for example. The reflective regions can be made, for example, by polishing the interior surface of an aluminum heat sink or by deposition of a thin reflective film on an aluminum heat sink surface. Additionally, the shape or configuration of the optical element can be changed to achieve a different distribution of light. For example, the radius of curvature of the optical element may be reduced in order to achieve a narrower distribution of light. Light directed towards the optical element may experience multiple reflections off of the optical element before being directed towards another optical element or exiting the lighting unit.

Figure 4:
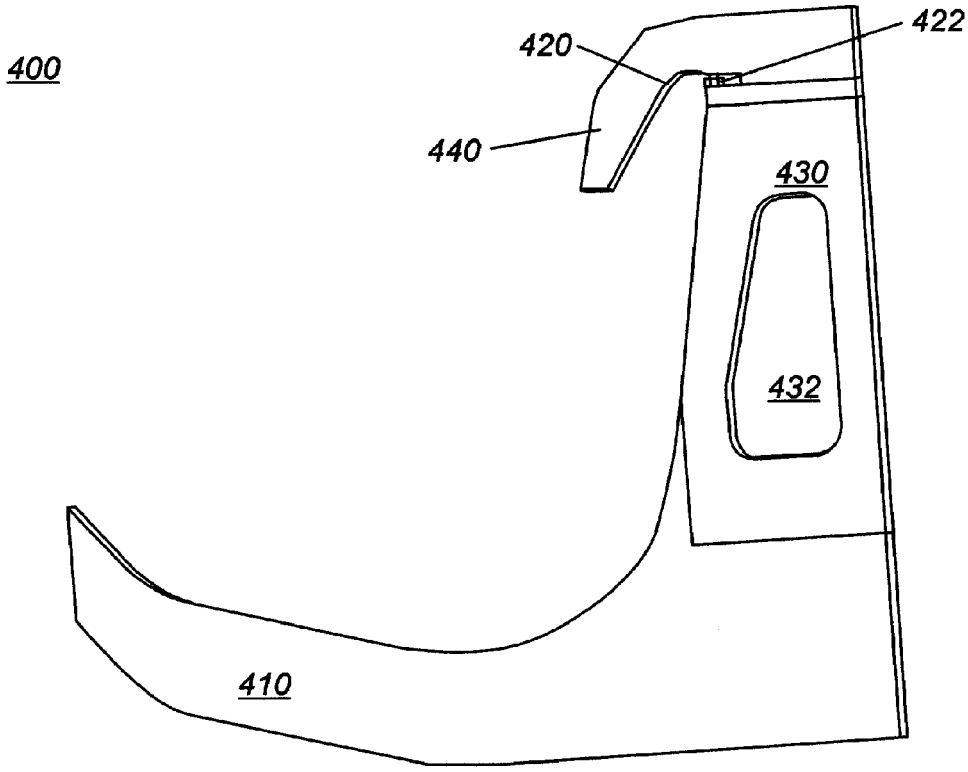
FIG. 4 is a cross-sectional view showing a single lighting strip with an optical element in accordance with an embodiment of the invention. The lighting strip may have the orientation as illustrated, or any other orientation. For example, the lighting strip may be inverted.

In some embodiments, the second optical element is a refractive optical element such as a lens. For example, in FIG. 4, a lighting unit 400 has a lens 410 used to distribute light generated by the luminescent material 420 and light emitting elements 424 mounted on a circuit board 422. The lens can be shaped to provide a broad or narrow distribution of light. The lighting unit 400 has a heat sink 430 with a hole 432. The base reflector 440 is angled to direct light through or from the lens 410. As previously mentioned, the lighting unit may have orientation. For example, the lighting unit shown in FIG. 4 may be inverted (turned upside-down).

Figure 5A:
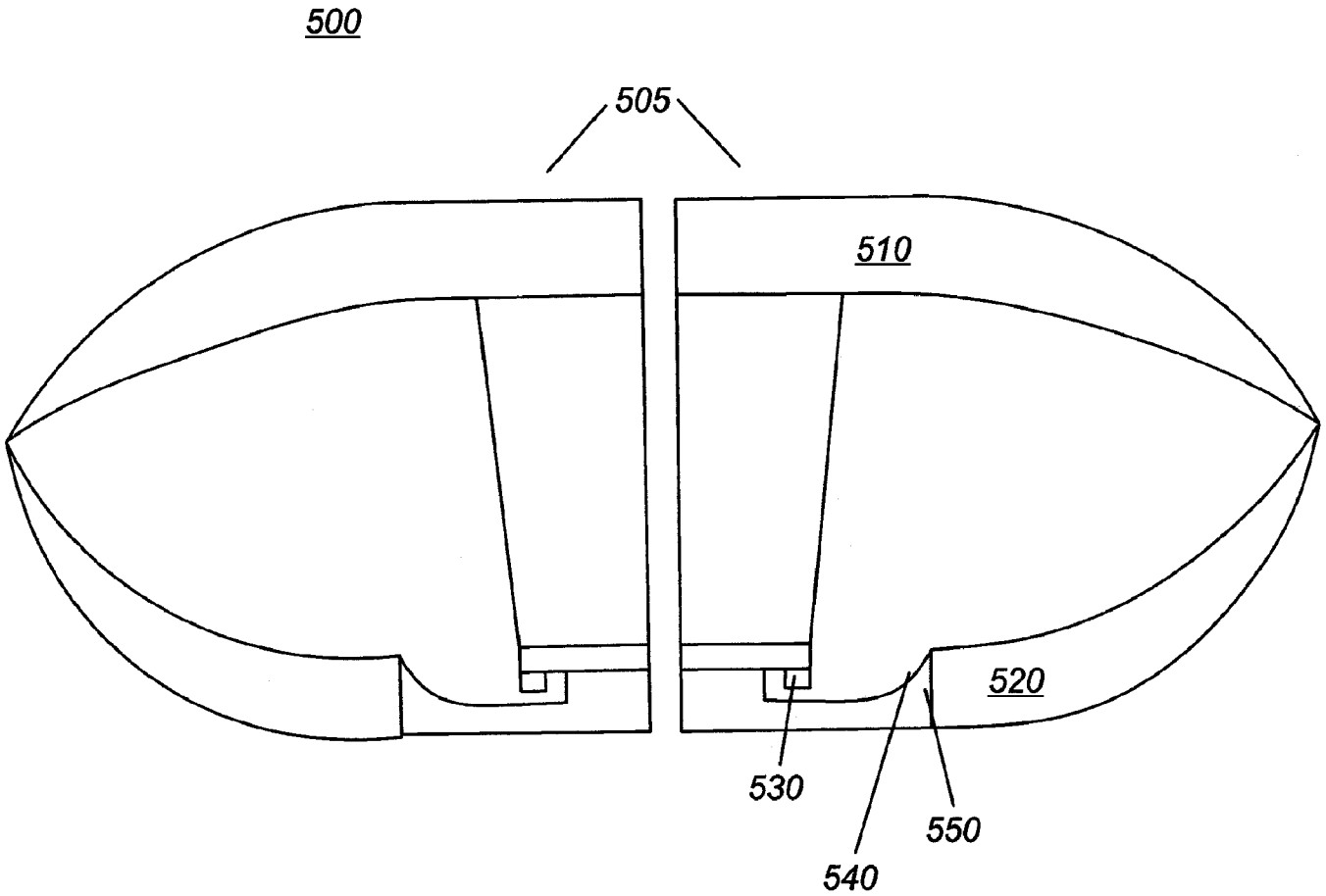
FIG. 5*a* is a cross-sectional view showing two lighting strips and two optical elements in accordance with an embodiment of the invention.
Figure 5B:
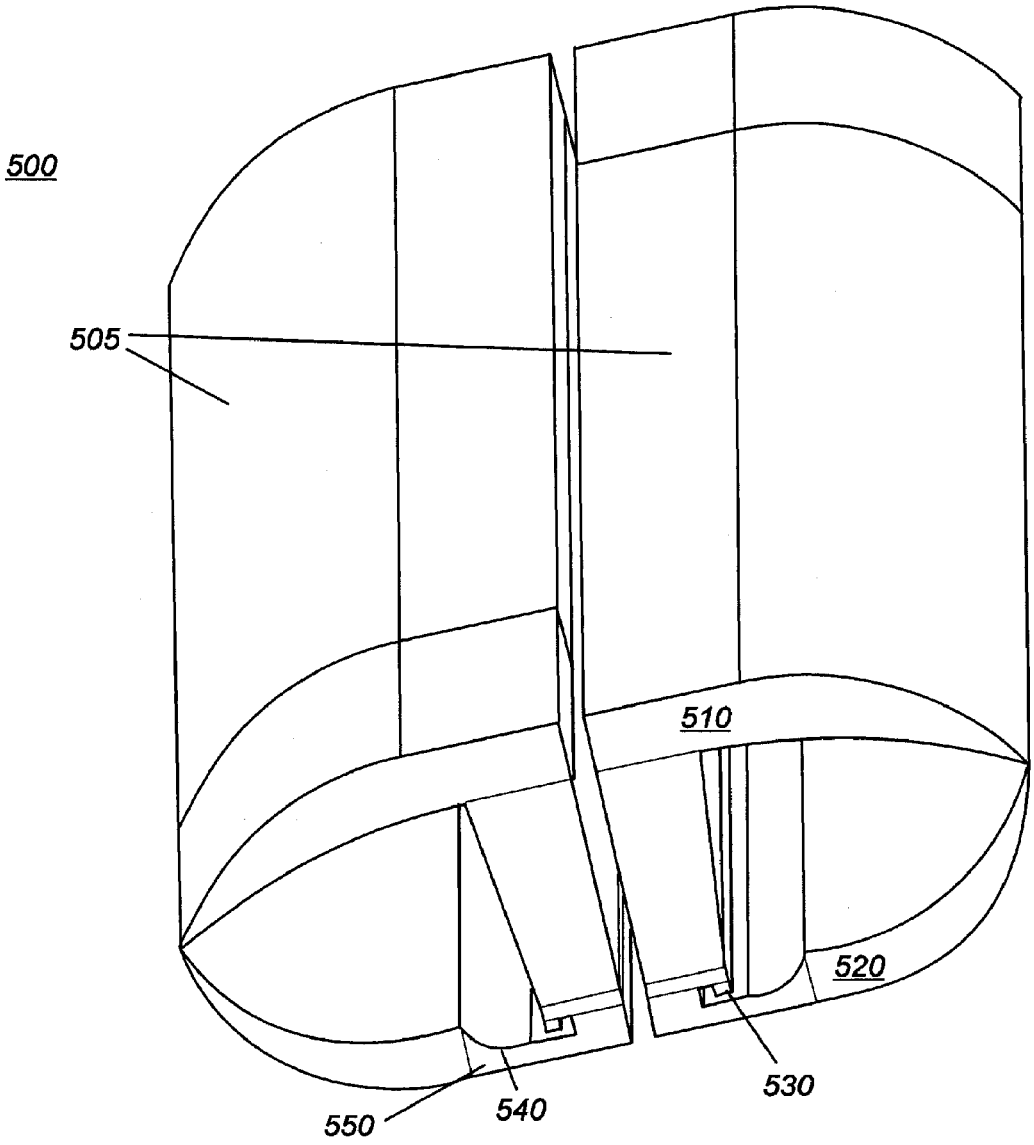
FIG. 5*b* shows a perspective view of two lighting strips.

In some embodiments, there is more than one second optical element. For instance, in FIG. 5, the lighting unit 500 has two lighting strips 505 each having a first optical element 510 that is a reflective optical element and a second refractive optical element 520. In this example, light from point source light emitting elements 530 is directed to a remote phosphor 540 disposed on a base reflector. The base reflector 550 reflects light from these elements onto the first optical element 510 which spreads the light. The light may then pass through a diffuser 520 which homogenizes the light emitted from the lighting unit. The diffuser may be optional.

FIG. 11 shows another example of a lighting unit with two or more second optical elements 1102*a*, 1102*b*. The second optical elements may be curved. In some embodiments, the second optical elements may be arranged substantially parallel to one another. The second optical elements may or may not contact one another. A plurality of second optical elements may have the same shape as one another. Alternatively, the second optical elements may have different shapes from one another. The second optical elements may be mirror images of one another. In one example, the second optical elements may be disposed on the lighting unit so that the lighting unit and/or the second optical elements are symmetrical about a plane intersecting the center of the lighting unit.

The second optical elements 1102*a*, 1102*b* may fit onto a support 1100. In some embodiments, the convex side of an optical element may be complementary in shape to a concave section of the support. In some embodiments, an upper surface of the optical element may be complementary in shape to a lower surface of the support. The second optical element may form reflective wings of the lighting unit. The second optical elements may form curved reflective surfaces of the lighting unit. The second optical elements may form semi-cylindrical shapes. A second optical element may be an upper reflector.

In some embodiments, the lighting unit may comprise one or more second optical elements that are positioned before the first optical element (e.g., a base reflector 240 or other first reflector 1104), such that a portion of the light emitted from the light emitting elements is directly incident on the at least one second optical element. The at least one second optical element may direct light to the first optical element, to another optical element, or out of the device. In one example, light emitted from one or more light emitting element may be incident on a first optical element or a second optical element. Light incident upon a first optical element may be directed to a second optical element. Light incident upon a second optical element may be directed to a first optical element and/or be distributed outside the lighting unit. In some embodiments, a portion of the light emitted by the at least one light emitting element is incident on a first optical element and a different portion of the light emitted by the at least one light emitting element is incident on one or more second optical elements. In some embodiments, reflective recycling may occur where light incident upon a first optical element may be directed to a second optical element, which may direct the light back to the first optical element, and so forth.

Luminescent Material

A luminescent material may be disposed on one or more component of the lighting unit. A luminescent material may be disposed on one or more optical element. For example, a luminescent material can be disposed on a first optical element without being disposed on a second optical element, disposed on a second optical element without being disposed on a first optical element, or may be disposed on both a first optical element and a second optical element. For example, a luminescent material may or may not be disposed on the base reflector. The luminescent material may or may not be disposed on a curved upper reflector. The light emitting elements and base reflector are positioned such that light emitted from the light emitting elements is at least partially directed towards the luminescent material. In some embodiments, the luminescent material is not disposed on any optical element.

A luminescent material may be disposed on a surface that is not light transmissive. In some embodiments, a luminescent material is not disposed on a transparent or translucent surface. In some embodiments, light is not transmitted through the luminescent material. Alternatively, a luminescent material may be disposed on a light transmissive surface and light may travel through the luminescent material.

A luminescent material may cover an entire surface or a portion of a surface. For example, the luminescent material may cover an entire underside of a second optical element. In another example, the luminescent material may cover an entire portion of the first optical element that may receive light emitted by the light emitting elements. In other instances, one or more parts of the described surfaces may have a luminescent material disposed thereon. The same luminescent material may be provided for all portions of the lighting unit having a luminescent material disposed thereon. Alternatively, different portions of the lighting unit may have different luminescent materials with different properties disposed thereon.

The luminescent material can comprise any material or combination of materials that phosphoresces or fluoresces when excited by light from the light emitting elements. The luminescent material may also comprise the binder, matrix or other material in which the phosphorescent or fluorescent material is dispersed. Any description of a luminescent material may apply to a phosphor or fluorescent material, or any combination thereof. A luminescent material may emit light when excited by light. The luminescent material may be a photoluminescent material where absorption of photons may cause re-radiation of photons. The re-radiation may or may not be delayed. The emitted photons may or may not be of lower energy than the absorbed photons. The luminescent material can be an inorganic material, an organic material, or a combination of inorganic and organic materials. The luminescent material can be a quantum-dot based material or nanocrystal. In some embodiments, a luminescent material disposed on a highly reflective material as provided by WhiteOptics LLC may be used.

Numerous luminescent material formulations can be used dependent on the excitation spectra provided by the light emitting elements and the output light characteristics desired. For example, when the light emitting elements provide an emission spectrum yielding white light with a high correlated color temperature, phosphors emitting light of a red and/or orange wavelength can be used to achieve lower/warmer correlated color temperature white light and to improve the color rendering index. A luminescent material can be used to maintain or vary the wavelength of light emitted by the lighting unit. For example, the wavelength of light emitting from a light emitting element may be up-converted or down-converted to a different wavelength by a luminescent material. Alternatively, the luminescent material need not alter the wavelength of light emitted from the light emitting element. Developments in luminescent materials and applications are generally described in Adrian Kitai, Luminescent Materials and Applications, Wiley (May 27, 2008) and Shigeo Shionoya, William Yen, and Hajime Yamamoto, Phosphor Handbook, CRC Press 2nd edition (Dec. 1, 2006), which are hereby incorporated by reference in their entirety.

A remote luminescent material refers to a luminescent material that is not inside or in physical contact with a light emitting element, such as an LED package. For example, a remote phosphor may be a phosphor that does not directly contact a light emitting element. In one example, a remote luminescent material does not contact a primary optic of the light emitting element. One advantage of using a remote luminescent material is that color consistency of a lighting unit product can be enhanced through control of the formulation and deposition of the luminescent material. For instance, when LEDs are fabricated they are binned according to their color characteristics. LEDs from different bins can be used in production of lighting units without sacrificing product to product color consistency if the quantity and formulation of the luminescent material is adjusted depending upon the exact spectral power density provided by LEDs.

Another advantage of using a remote luminescent material is that there may be reduced thermal quenching of the luminescent material because it is physically displaced from the heat generating light emitting element, such as an LED package. Thus, the color of the light is more consistent with lifetime and operating temperature. In comparison, in a luminaire that employs a typical warm white LED, the red and/or orange phosphor material is in direct contact with the LED package and will quench rapidly as the LED is operated at higher temperature resulting in a noticeable shift in color point.

A further advantage of using a remote luminescent material is that to achieve a warmer color temperature, the selection of the luminescent material is not limited only to materials that can operate well at higher temperatures. This can open up a range of materials that are not available to typical LED configurations.

Still another advantage of using a remote luminescent material is an increased luminescent material lifetime due to the decreased operating temperature.

An optical element, such as a base reflector, may be thermally conducting, or may be disposed on a thermally conductive material, such as aluminum, so that heat generated by the luminescent material due to Stokes shift energy losses is conducted away. Thermal management at the luminescent material location can reduce thermal quenching of the quantum efficiency of the luminescent material and increase overall luminescence efficiency.

The luminescent material can be disposed on a surface of the lighting unit, such as an optical element, in various ways, including evaporation, spray deposition, sputtering, titration, baking, painting, printing, or other methods known in the art, for example. In some embodiments, the selected surface of the lighting unit may comprise grooves, pockets, or knobs into or onto which the luminescent material is disposed to control the optical distribution of the light emitted by the luminescent material.

In embodiments where the luminescent material is disposed on abase reflector or other optical element (e.g., second optical element), the conversion efficiency of the luminescent material can be improved. Generally, remote luminescent materials are disposed on a light transmitting material such that the pump light has one pass through the luminescent layer. In the case where the luminescent material is disposed on a reflective material, a portion of the pump light that is not converted on the first pass is reflected back through the luminescent material for a second chance for conversion. Due to the improved conversion efficiency of the luminescent material, less luminescent material is needed.

In embodiments where the luminescent material is disposed on the base reflector, and a diffusely reflective second optical element is used, the conversion efficiency of the luminescent material can be even further improved. Generally, remote luminescent materials are disposed on a light transmitting material such that the pump light has one pass through the luminescent layer. In the case where the luminescent material is disposed on a reflective material, a portion of the pump light that is not converted on the first pass is reflected back through the phosphor for a second chance for conversion. When a second optical element that is a diffuse reflector is used, a reasonable percentage of the light striking this diffuse reflector is re-directed back towards the luminescent material for yet another pass at conversion and allowing at least two more, or a total of four passes through the luminescent material and base reflector. For some portion of the light, even more passes will be obtained. Due to the improved conversion efficiency of the luminescent material, this design minimizes the total amount of luminescent material needed for a given level of conversion.

In some embodiments, only a remote luminescent material may be provided on a lighting unit. For instance, no luminescent material is contacting a light emitting element. Alternatively, a local luminescent material may contact a light emitting element without a remote luminescent material being provided on the lighting unit. Alternatively, both a local and remote luminescent material may be provided for the lighting unit.

In some embodiments, a light emitting element may be directed toward a remote luminescent material. Light may hit a remote luminescent material directly from the source of light. In some embodiments, scattered light may also reach the remote luminescent material. Light may be directed upward to a remote luminescent material. Alternatively, light may be directed downward to a remote luminescent material.

A first or second optical element may be used to direct light to a remote luminescent material. In some embodiments, light may be directed in a different direction from a primary direction of illumination. For example, if a primary direction of illumination is downward, light may be directed upwards, or upwards at an angle.

Without Luminescent Material

In some embodiments, no luminescent material is included in the lighting unit or on certain selected portions of the lighting unit. For example, one or more of the lighting strips in a lighting unit may not have a luminescent material disposed on the base reflector. One or more non-coated reflectors may be provided in the lighting unit.

A lighting unit may comprise lighting strips of various colors, such as blue, white and/or red. Each of the lighting strips may comprise light emitting elements that emit light of a desired color, such that down conversion of the light by a luminescent material is not necessary. In another example, the lighting unit is an ultraviolet light source or an infrared light source requiring no down conversion of the light generated by the light emitting elements. The lighting strip may have a heat dissipating support structure, a base reflector, and also may have one or more optical elements, and/or at least one convection path as described herein. However, the lighting strips may not have a remote luminescent material disposed on the base reflector. In another example, the lighting strips do not have a remote luminescent material disposed on a second optical element, such as a curved reflective surface.

Without Base Reflector

Figure 9:
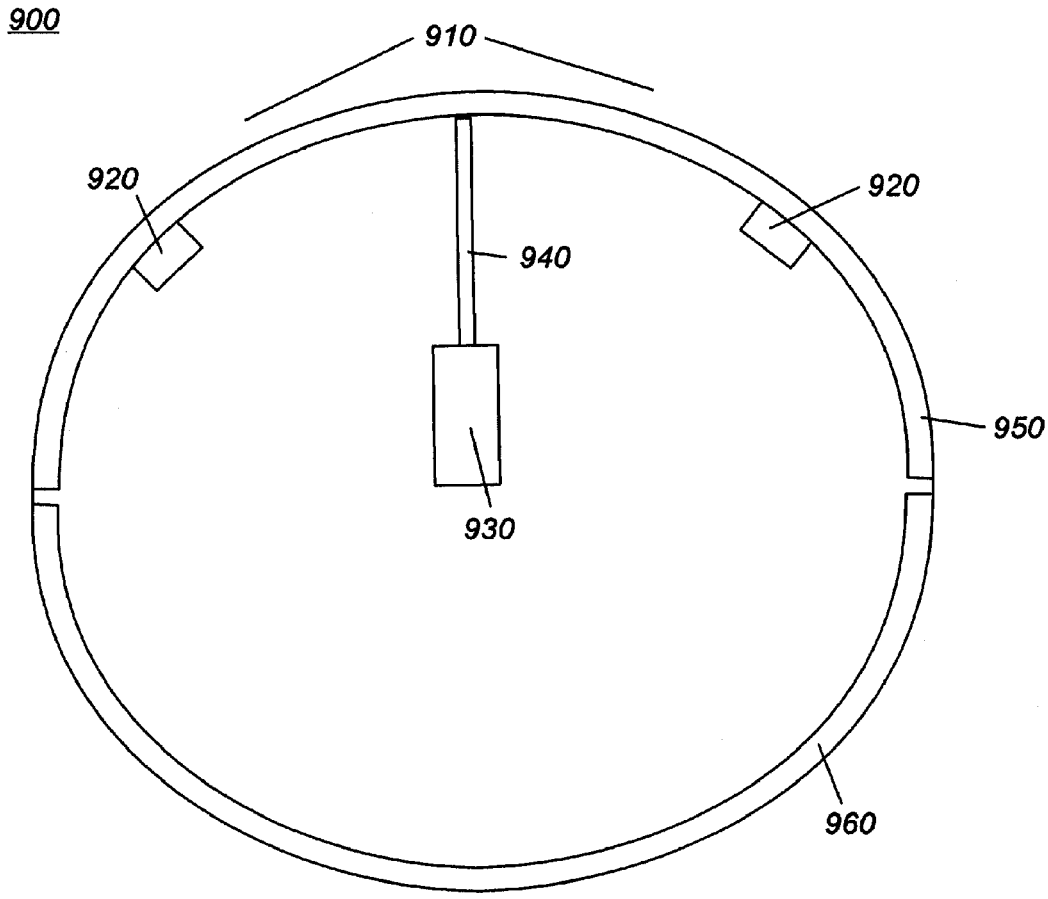
FIG. 9 is a cross-sectional view of a lighting unit having two lighting strips that have no base reflector and that share a common luminescent material and optical elements, in accordance with an embodiment of the invention.

In some embodiments, the lighting unit may be provided without a first optical element. For example, a lighting unit is provided that has at least one lighting strip without a base reflector. In this case, the lighting strip has a plurality of light emitting elements, a heat dissipating support structure, a luminescent material, and optionally one or more optical elements to achieve a desired distribution of light. The lighting unit may optionally have a convection path. Rather than a base reflector, the luminescent material is disposed on or embedded in a substantially non-reflective surface. For example, FIG. 9 shows a cross-sectional view of a lighting unit 900 having two lighting strips 910 each having its own array of light emitting elements 920 and having a shared luminescent material 930 that is not disposed on a base reflector. Rather, the luminescent material 930 can be embedded in or disposed on an at least partially transparent plastic strip 940, for example. The lighting strips 910 can also share a common reflective optical element 950 and a common refractive optical element 960, for example. In another example, the luminescent material is disposed on or embedded in a different substantially reflective surface.

Alternatively, the lighting unit may be provided without a second optical element. Rather than the second optical element, the luminescent material may be disposed on or embedded in a substantially non-reflective surface, or on a first optical element.

The lighting unit may be provided without any optical elements. A luminescent material may be disposed on a surfacing of the lighting unit. For example, the luminescent material may be disposed on a support structure.

Using optical elements, luminescent materials, or a combination thereof, a very broad distribution of light can be achieved from even point source light emitting elements. Thus, a highly efficient, diffuse light source can be obtained. A major limitation of state of the art LED based fluorescent tube replacements is that LED point source emitters are used and the light is not adequately spread to provide a pleasant lighting experience. The LEDs are directly viewable or covered only by a low efficiency refractor. This provides harsh light with potential for glare and little control over the beam distribution. Furthermore, color quality and color consistency are limited by the LEDs. The invention may provide advantageous improvements in light distribution from a lighting unit that may use light emitting elements, such as LEDs.

Distribution of Light

The light emitting elements may be positioned such that light emitted by the light emitting elements is directed towards a luminescent material. The luminescent material may be provided on an optical element, or any other surface of the lighting unit. The excited luminescent material may emit light of a longer wavelength. Alternatively, the excited luminescent material may emit light of the same or a shorter wavelength. This light may be emitted in multiple directions from the luminescent material. Some of the light emitted by the luminescent material may travel in a direction away from a first optical element, such as the base reflector, and may leave the lighting unit or be reflected or refracted by an optical element. Some of the light emitted by the luminescent material may travel towards the base reflector which is positioned to reflect the light out of the lighting unit or towards an optical element. Light from the light emitting elements that is not absorbed by the luminescent material may also be reflected by the base reflector and directed out of the lighting unit or towards an optical element.

A first optical element, such as a base reflector, may comprise means of directing light emitted from the luminescent material. For example, the base reflector may have a photonic crystal structure, or lens shaped pockets upon which the luminescent material is disposed. Such structures may aid in directing light emitted from the luminescent material to a second optical element, for example. In another example, a second optical element may comprise features configured to direct light emitted from a luminescent material disposed thereon. Such features may aid in directing light emitted from the luminescent material to a first optical element, or away from the lighting unit.

In some embodiments there are no second optical elements, so the light distribution is controlled by the position and shape of the first optical element, such as the base reflector. The base reflector can have optical features to aid in appropriately directing the light. For example, the base reflector can have reflective dimples or mounds, index-adjusting surface coatings, or other features to direct unconverted light from the light emitting elements and light from the luminescent material towards the optical element or out of the lighting unit. Additional diffusing of the light can occur through the cover.

In other embodiments, there are one or more optical elements. These optical elements can aid in achieving a broader (or narrower) distribution of light. In one exemplary embodiment, the lighting unit has an optical element that is partially reflective and partially refractive.

For further control of light distribution, the lighting unit may be rotatable. For instance, for a linear lighting unit, the lighting strip or a reflective optical element may be configured to rotate about the long axis. In some embodiments, one or more optical element may be adjustable, thereby permitting a user to adjust the light distribution.

Glare Reduction

One advantage of the present work is that the beam angle can be well controlled. This allows for a lighting unit that need not be recessed as typical fluorescent lamps need to be to reduce glare. The control of the light distribution through the use of optical elements allows light distribution to be tailored such that light is directed on the work surface and little or no light is directed at high angles that can cause glare. This can be accomplished without the need for an external luminaire, essentially enabling the replacement lamp to operate as its own luminaire.

Indirect Light Exposure

In some embodiments, a lighting unit may comprise a support structure, an at least partially reflective reflector extending substantially along the length of the support, and a plurality of light emitting elements disposed along the length of said support structure, wherein light from said light emitting elements does not pass through secondary optics, and wherein the light from said light emitting elements is reflected at least once before leaving the lighting unit.

In some embodiments, light from a lighting unit does not directly leave the lighting unit without being reflected from a surface of the lighting unit. In some embodiments, no direct line of sight is provided from the outside of the lighting unit to a light emitting element. In some embodiments, non-light transmissive portions of the lighting unit may block a direct line of sight to a light emitting element. In some embodiments, opaque or substantially opaque portions of the lighting unit may block one or more light emitting element from view when the lighting unit is viewed from the outside. In some embodiments, the light emitting elements may be blocked from view at certain angles, and not blocked from view at certain other angles. In one example, light emitting elements may be blocked from direct view when an elongated lighting unit is viewed from an elongated side, or from above or below, but not when viewed from the ends; or any other combination thereof. In some embodiments, an optical element, such as a reflector, may block and prevent light from the light emitting elements from directly leaving the lighting unit. The lighting unit may be configured to provide indirect illumination.

In some embodiments, the lighting unit may have an elongated form. In some embodiments the support structure may be a linear support structure. The light emitting elements may be open-air light emitting elements that may be exposed directly to the environment. The lighting unit may have a vented structure. The light emitting elements need not be contained within a cover of the lighting unit. In some embodiments, air may flow from a region exterior to the lighting unit to contact a light emitting element.

In some embodiments, the lighting unit may be provided as a replacement for a pre-existing conventional lighting fixture, such as a fluorescent tube, but may not require a cover.

In alternate embodiments, direct light exposure may be provided. A direct line of sight may be provided between a light emitting element and a viewer exterior to the lighting unit. In some embodiments, light may pass through a light transmissive optic to reach a viewer exterior to the lighting unit.

Support Structure

A lighting unit may include a support structure which may be rigid or semi-rigid. The support structure may provide support to one or more component of the lighting unit.

The support structure may have a linear configuration, or any other configuration, including those described elsewhere herein. The support structure may have a length that is greater than any other dimension (e.g., width, height) of the support structure. The support structure may have an elongated shape. In some embodiments, the support structure may have a flattened shape.

The support structure may be formed of a single integral piece. Alternatively, the support structure may be formed of multiple pieces. In some embodiments, a support structure may be provided for a lighting strip, and a lighting unit may include one or more lighting strip.

A support structure may be a heat dissipating support structure. A heat dissipating support structure may function as a heat sink. For example, a heat dissipating support structure can be formed of a material of high thermal conductivity. For example, the heat dissipating support structure can be formed of one or more material with a thermal conductivity of about 10 W/mK or more, 20 W/mK or more, 50 W/mK or more, 100 W/mK or more, 150 W/mK or more, 200 W/mK or more, 250 W/mK or more, 300 W/mK or more, or 400 W/mK or more. The heat dissipating support structure can be formed of a thermally conductive metal such as aluminum, copper, gold, silver, brass, stainless steel, iron, titanium, nickel, or alloys or combinations thereof. The heat dissipating structure can be formed of any other thermally conductive material such as a thermally conductive plastic, silicon carbide, crystalline graphite, diamond, or graphene. In some embodiments, the heat dissipating support structure can form the sides of the convection path, making a chimney for heat escape from the lighting unit. The chimney may be discussed in further detail elsewhere herein. The heat dissipating support structure may have thermal fins, grooves, knobs, pins, rods, or other features to further improve the cooling of the LEDs. Alternatively, the heat-dissipating support structure need not require any surface features, such as fins, in order to cool the lighting unit.

The support structure may be optional. In some instances, a circuit board or an optical element may function as a support structure. For example, a circuit board or optical element as described elsewhere herein may function as a support structure or be integrally formed as part of a support structure.

FIG. 11 shows an example of a support structure 1100. The support structure may form an upper surface of the lighting unit. The support structure or an upper portion of the support structure may be directly exposed to open air. In alternate implementations, the support structure may form a lower surface of the lighting unit, a side surface of the lighting unit, or any combination of surfaces of a lighting unit.

Chimney

A support structure may have a shape that may permit the formation of a convection path through the lighting unit.

Figure 10E:
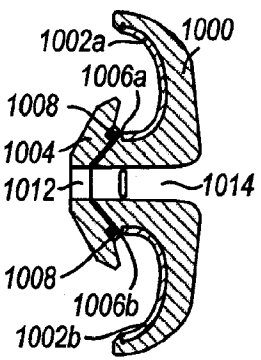
FIG. 10*e* shows a cross section of the lighting unit.
Figure 10C:
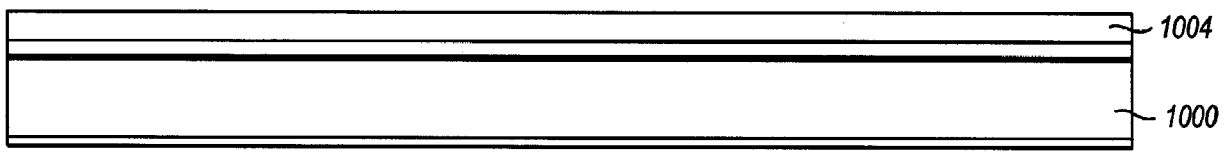
FIG. 10*c* shows another side view of a lighting unit.
Figure 10D:
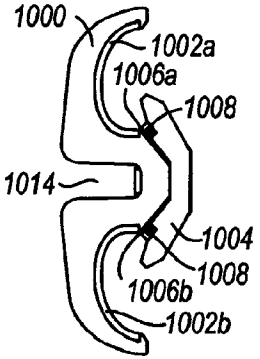
FIG. 10*d* shows a first end of the lighting unit.

A space may be provided between portions of the support structure. FIG. 10D and FIG. 10E shows an example of a space 1014 that may be provided between portions of the support structure. The space may be completely open on top, partially open on top, or may be enclosed within the support structure. The space may extend along the entire length of the support structure, or along portions of the length of the support structure. In some embodiments, the space between portions of the support structure may form a channel extending lengthwise along the support structure. The channel may extend along the entire length of the support structure, or may extend along one or more portions of the length of the support structure. In some embodiments, a cross-section of a support structure may include one, two or more arching wings. A space between portions of the support structure may be provided between two or more arching wings of a support structure. A channel depth may be about the same, greater than, or less than the bottom of the arching wings. The channel may have a depth greater than, less than, or equal to about 0.5 mm, 1 mm, 1.5 mm, 2 mm, 2.5 mm, 3 mm, 4 mm, 5 mm, 6 mm, 7 mm, 8 mm, 9 mm, 10 mm, 12 mm, 15 mm, or 20 mm. A channel width may be large enough to permit the formation of a convection path through the channel. The channel may have a width greater than, less than, or equal to about 0.5 mm, 1 mm, 1.5 mm, 2 mm, 2.5 mm, 3 mm, 4 mm, 5 mm, 6 mm, 7 mm 8 mm, 9 mm, 10 mm, 12 mm, 15 mm, or 20 mm. In some embodiments, the channel width may be greater than, less than, or equal to about 1%, 2%, 3%, 4%, 5%, 6%, 7%, 8%, 9%, 10%, 12%, 15%, 20%, 25%, or 30% the width of the support structure. In some embodiments, the channel depth may be greater than the channel width. Alternatively, channel depth may be less than or equal to the channel width. A channel may have any cross-sectional shape including, but not limited to, a triangle, rectangle, trapezoid, hexagon, circle, semicircle, ellipse, or any other shape.

The support structure may include a lower surface in the direction of illumination. In some embodiments, the lower surface may include one, two, or more shaped features. For example, two substantially parallel shaped features may be provided. The space may be provided between the two shaped features. In some embodiments, the cross-sectional shape of the shaped features may be concave when viewed from a lower perspective. The lower shaped surface may be a curve extending lengthwise along the support structure. The lower surface may be smooth, rough, or any combination thereof.

Figure 6:
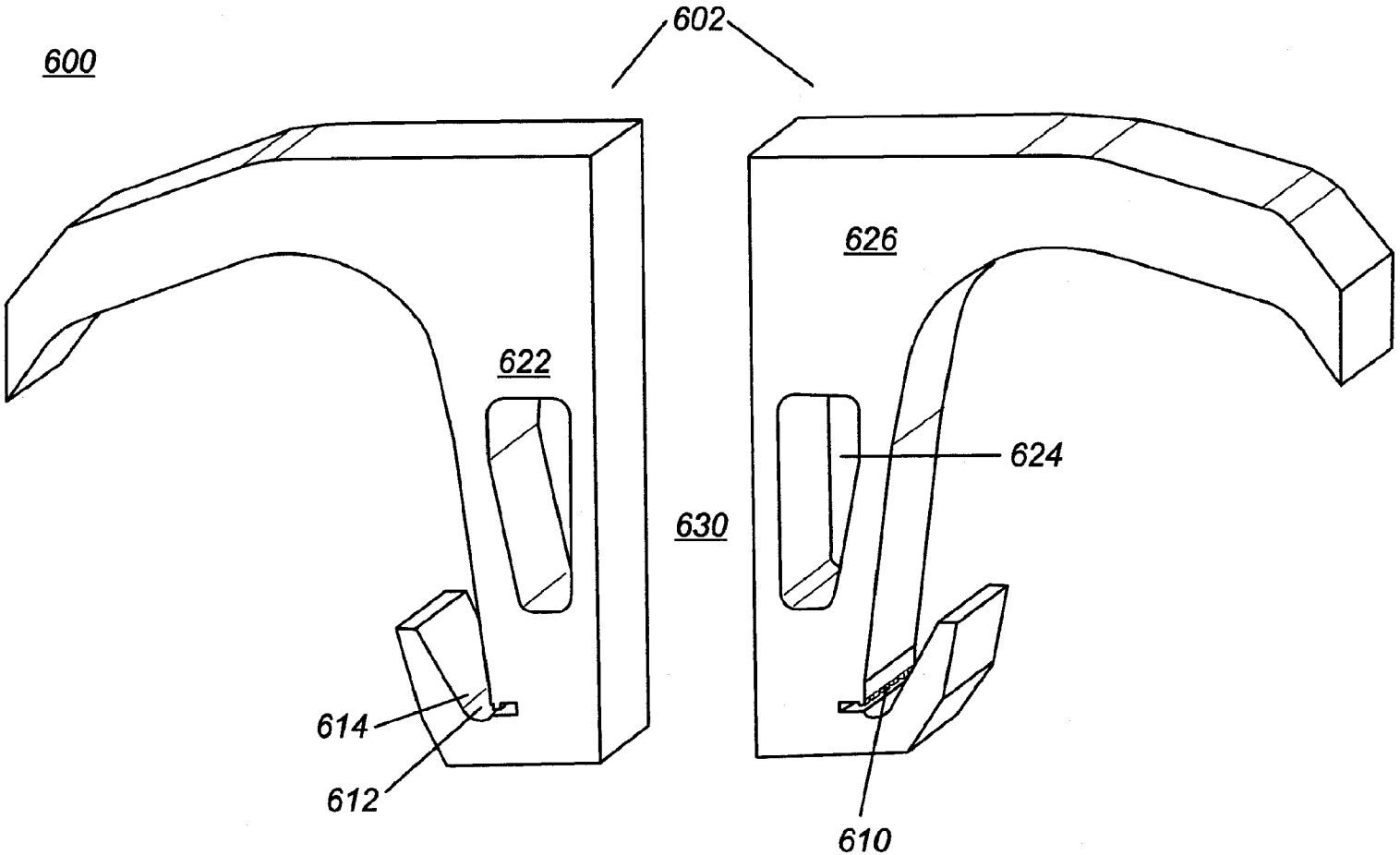
FIG. 6 is a cross-sectional view with two light emitting strips with light emitting elements oppositely oriented, and with a base reflector and an optical element.

In some embodiments, as shown in FIG. 6, lightings strips of a lighting unit can be mounted substantially parallel to one another to provide a convection path 630. The convection path may be provided between the lighting strips 602.

A space to permit convection may be provided between portions of a single integral support structure. Alternatively, a space to permit convection may be provided between multiple separable portions of the support structures or between a plurality of support structures.

In some embodiments, at least one passageway may be located between at least two light emitting elements. The passageway may be located between at least two light emitting elements that may be part of separate rows of light emitting elements. For example, the passageway may be located between a first light emitting element belonging to a first row of light emitting elements and between a second light emitting element belonging to a second row of light emitting elements. The first row of light emitting elements may be provided on a first circuit board and a second row of light emitting elements may be provided on a second circuit board. The passageway may be located between two rows of light emitting elements.

The passageway may be provided through the heat dissipating support structure to the space between the portions of the support structure. In some embodiments, the passageway may be provided through a first optical element, such as a base reflector.

The passageway may be a thermal conduit that may permit a convection path to travel therethrough. The passageway may be a part of a thermal chimney through which air may flow in a convection path. A thermal conduit may be in fluid communication with a space between portions of the support structure.

A passageway may provide fluidic communication between a region below the lighting unit and a region above the lighting unit. A passageway may provide fluidic communication between an underside of the lighting unit and a space between two or more portions of the lighting unit.

A lighting unit may have one or more vertically oriented passageway. The passageway may be oriented parallel to a direction of primary illumination. A plurality of passageways may have the same orientation. Alternatively, they may have differing orientations. In some instances, a lighting unit may have a plurality of passageways, such as two, three, four, five, six, or more passageways. The passageways may be provided in a row. The passageways may be oriented so that elongated portions of the passageways are located end to end within a row. The passageways may be oriented parallel to one another.

In some embodiments, the passageway may have an elongated shape. The passageway may optionally have a cross-sectional area greater than, or equal to about 3%, 5%, 7%, 10%, 12%, 15%, 20%, 25%, 30%, or 50% of the support. The passageway may have a width greater than, or equal to about 0.5 mm, 1 mm, 1.5 mm, 2 mm, 2.5 mm, 3 mm, 4 mm, 5 mm, 6 mm, 7 mm 8 mm, 9 mm, 10 mm, 12 mm, 15 mm, or 20 mm. In some instances, the width:length ratio of the passageway may be about 1:20, 1:15, 1:10, 1:7, 1:5, 1:4, 1:3, 1:2, or 1:1. The passageway may advantageously permit the formation of a convection path that may cool the lighting unit.

FIG. 10A shows an example of one or more passageway 1012 that may be provided. The passageway may lead to a space 1014 between two or more portions of a support structure 1000. The passageway 1012 may be located between a plurality of lighting units 1008. In some embodiments, the passageway may be located between a plurality of circuit boards 1006*a*, 1006*b*. Alternatively, the passageway may be located through a single circuit board. The passageway may be provided through the support structure 1000. Alternatively, the passageway may be located between a plurality of support structures.

Convection Path

A convection path can provide a good thermal pathway for unwanted heat to travel away from the light emitting elements. The convection path may be substantially vertically oriented for optimal air flow. The shape of the convection path can be tailored to provide an optimal air flow rate. The convection path can exist through the core of the lighting unit, allowing the flow of air to effectively cool the heat generating and heat sensitive light emitting elements. For instance, a heat dissipating support structure can form the sides of the convection path, making a chimney for heat escape from the lighting unit. The chimney can optionally be formed by the passageway through an optical element, and the walls of a channel in the heat dissipating support structure. The convection path may flow through the passageway and the channel. The passageway may permit air to enter the chimney. The heat dissipating support structure may or may not have thermal fins, grooves, knobs, pins, rods, or other features to further improve the cooling of the LEDs.

LEDs have reduced efficiency and lifetime at higher operating temperatures. Thus, with improved thermal management, the efficacy and lifetime of LEDs in the lighting unit can be improved. Typical LED-based fluorescent lamp replacements rely on a horizontal convection path to cool the light emitting elements, but this is less effective at reducing LED operating temperature. Some designs have a horizontal heat sink with grooves or fins to help dissipate the heat, but these features, having very little air flow around them, do very little to remove heat from the system.

Embodiments of the invention described herein may permit the formation of a natural convection through the lighting unit. The hottest portion of the lighting unit may be at, or near the convection path. In one example, the circuit board right behind a light emitting element may provide heat, which may be conducted through a heat dissipating support structure to a surface of the support structure. A light emitting element may be in thermal communication with the heat dissipating support structure. The heat may be conducted to a surface of the support structure that forms part of the chimney (e.g., a wall of a channel or space between portions of the heat dissipating support structure). Air may flow through the chimney and may contact the wall of the chimney, thereby dissipating heat.

In some embodiments, the hottest portion of the lighting unit may be located at or near a bottom portion of the lighting unit. Heat may be conducted to a surface of the heat dissipating structure that may form part of the chimney. Heat may be conducted a relatively short distance to the surface of the heat dissipating element that forms part of the chimney. In some embodiments, heat may be conducted to a lower portion of the chimney. As air near the lower portion of the chimney is heated, the air may rise up the chimney, thereby forming a convection path. Air flow may occur in an upward direction through the chimney. In some embodiments, the hottest portion of the chimney wall may be at or near the bottom of the chimney. The hottest portion of the chimney wall may be within the lower half of the chimney, lower third of the chimney, lower quarter of the chimney, lower fifth of the chimney, lower sixth of the chimney, or lower eighth of the chimney.

The lighting unit may employ natural convection to assist with heat dissipation from the lighting unit. The lighting unit may not require forced air convection. Convection may occur without requiring a fan or other forced air apparatus.

The convection path may be a straight path through the chimney. The air may flow in a straight path without requiring any bending. The convection path may be a straight vertical path. The chimney may form a straight conduit without any bending. In some embodiments, a venturi may be used. The chimney may have a constricted section which may alter fluid flow speed and/or pressure. Venturi effects may be observed through the chimney.

In some alternate embodiments, a convection path may be formed that need not pass through the lighting unit. The convection path may be formed along a side of the lighting unit. For example, a hottest surface of the lighting unit may be located at a lower portion of the side of the lighting unit. The air next to the lower portion of the side of the lighting unit may be heated, and may rise, creating an upward air flow along the side of the lighting unit.

Fastener

A lighting unit may include any number (e.g., one, two, three, four or more) fasteners. A fastener may be used to connect one or more components of a lighting unit. For example, a fastener may cause a support structure, circuit board, and first optical element to contact one another. In some embodiments, a fastener may be used to tighten one or more components of a lighting unit together. For example, one or more fastener may cause a strong contact between the support structure, circuit board, and first optical element. In some embodiments, a strong contact may assist with heat dissipating from one or more light emitters disposed on the circuit board.

The fasteners may have any configuration or arrangement that may allow them to connect the first optical element, support structure, and circuit board. For example, the fasteners may be provided in a linear axial arrangement.

A fastener may pass between two or more circuit boards or parts of a circuit board and may pass through a first optical element. A fastener may pass through or partially penetrate a support structure. In some embodiments, the fastener may be a screw, nail, bolt, peg, pin, rivet, clamp, buckle, snap, staple, clasp, tie, or any other type of mechanical fastener. In some embodiments, one or more components may be connected to one another by using magnets, an adhesive, eutectic bonding, thermosonic bonding, soldering, brazing, or welding, press or snap fitting, or using interlocking pieces.

FIG. 11 shows an exploded view of a lighting unit provided in accordance with an embodiment of the invention. A plurality of fasteners 1110 may be provided to connect portions of the lighting unit. The fastener may be located on an underside of the lighting unit. In other embodiments, the fasteners may be provided along a side or from the top of the lighting unit. The fasteners may be provided along the length of the lighting unit. In some embodiments, the fasteners may be evenly distributed along the length of the lighting unit.

FIG. 10A provides an additional view of fasteners 1010 that may be provided in accordance with an embodiment of the invention. The fasteners may pass through a first optical element 1004 and into a support structure 1000. In some embodiments, the fastener may or may not protrude into a space 1014 between portions of the support structure. The fastener may or may not pass between a plurality of circuit boards 1006*a*, 1006*b*.

In alternate embodiments, fasteners may not be required. For example, adhesives may be used to connect various portions of the lighting units. In other examples, portions may be press-fitted or locked into places using other mechanisms known in the art.

Lighting Unit Configurations

A lighting unit may be provided in accordance with one or more embodiment of the invention. Features or characteristics from various embodiments may be combined with other embodiments.

Twin Side Emitter

In one exemplary embodiment, shown in FIG. 6, the lighting unit 600 has two lighting strips 602 mounted substantially parallel to one another in the lighting unit. The two lighting strips may be mechanically coupled to one another with crossbars or end caps, for example. Furthermore, the lighting strips may be mounted back to back and with a space 630 between lighting strips that may serve as a chimney to remove heat from the system. The space 630 between lighting strips may have a shape to maximize the effectiveness of heat removal from the system. The light emitting elements 610 may be side-emitting white LEDs containing a blue-emitting LED chip with a phosphor coating in direct contact with the LED chip. The lighting unit 600 can be referred to as a "twin side emitter" due to the use of two similar or identical lightings strips comprising side emitting LEDs. The twin side emitter may be a replacement lamp for a fluorescent tube. The twin side emitter may be configured to mechanically and/or electrically couple to receptacles in a conventional fluorescent lighting fixture.

In this embodiment, the luminescent material 612 on the base reflector 614 may be a remote phosphor. Thus, there may be a package level conversion of the light and a remote phosphor conversion of the light. This design is advantageous because the LED chips used as light emitting elements can be side emitting LEDs from color bins rejected by display manufacturers. The cost of these high efficiency LEDs can be very low. Because the color of these LEDs may not be optimal for general illumination, a secondary, remote phosphor, can be used. In this embodiment, the remote phosphor may be a red and/or orange phosphor which is used to lower the correlated color temperature and improve the color rendering index of the lighting unit's output light.

Within a lighting strip 602, the side emitting LEDs 610 may be linearly arranged and mounted on a heat sink 622. The heat sink may be at least partially metallic and may have one or more holes 624 to reduce the weight of the lighting strip and/or aid in convection. In this embodiment, the lighting strip 602 may have a reflective optical element 626 positioned to broadly reflect light so as to achieve a desired distribution of light. The base reflector 614 and the reflective optical element 626 may be configured such that the beam angle may be between twenty to eighty degrees. The beam angle, as known in the art, refers to the angle at which the light output of the luminaire decreases to 50% of maximum intensity when viewed parallel to the light source.

The two lighting strips 602 may be mounted back to back, such that the light emitting elements 610 are emitting in substantially opposite directions, though not necessarily 180 degrees apart. With each strip providing a distribution of light between twenty to eighty degrees, the lighting unit 600 can provide a very narrow or broad distribution of light in the area of desired illumination. In one particular embodiment, the beam angle of each lighting strip is 45 degrees, so the lighting unit has a total beam angle of 90 degrees which matches that of a typical fluorescent luminaire. Further control of the beam light distribution can be achieved by having rotatable lighting strips. For example, the two lighting strips may be configured to rotate about the long axis of the lighting unit. The lighting strips may rotate individually, or simultaneously in opposite, or similar directions.

Multiple Side Emitter

Figure 7:
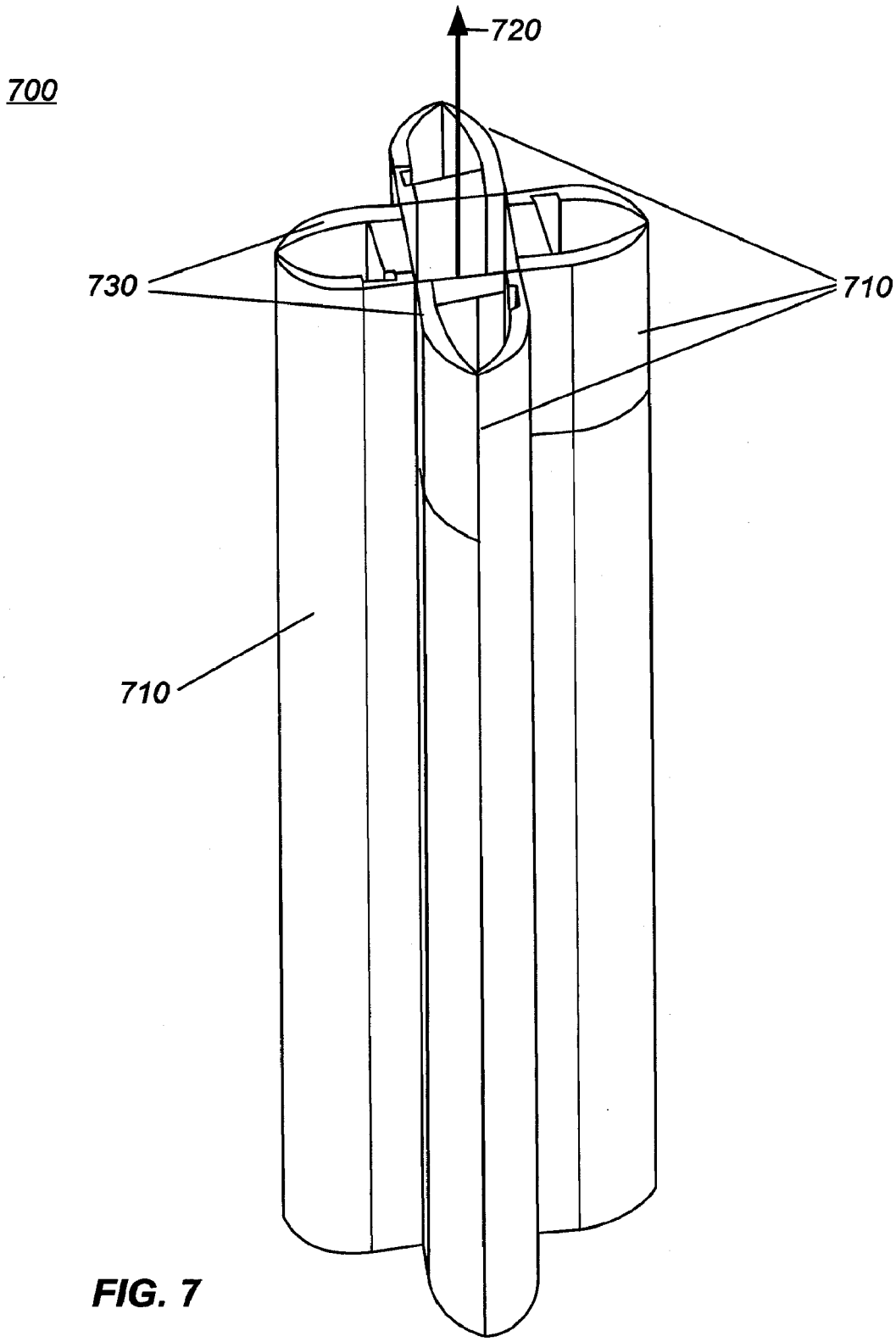
FIG. 7 illustrates a lighting unit having four lighting strips.

The lighting unit of the present work may have any number of lighting strips of any number of shapes. Thus, the lighting unit may be used in a variety of applications. In a non-limiting example, a lighting unit with a single linear lighting strip may be used as a step light or cove light in architectural lighting. A lighting unit with two lighting strips can be configured as a circular, u-shaped, or linear fluorescent tube replacement, for example. A lighting unit with three lighting strips may have a triangular shape, for example. A lighting unit with four linear lighting strips may be used in a multiple side emitter, for example, as shown in FIG. 7. The lighting unit 700 may comprise four linear lighting strips 710 arranged at right angles to one another about a center axis 720 as shown in FIG. 7. In this embodiment, each lighting strip may have an optical element that is both reflective and refractive 730 to broadly distribute the light. The optics can be tailored such that the far-field luminance is substantially uniform about a center axis 720 of the lighting unit. Such a lighting unit can be used as a pendant lamp, in architectural lighting, or as a fishing light, for example. A lighting unit having six lighting strips may have the shape of a tetrahedron. The lighting unit may be configured to serve as a decorative light that hangs from the ceiling. One face of the tetrahedral lighting unit may be parallel to the ceiling. The three lighting strips of this face may be configured to direct most of their light "down" to the workspace. The remaining three lighting strips may be configured to provide a broad distribution about the lighting unit.

Lighting Strips with Shared Components

Figure 8:
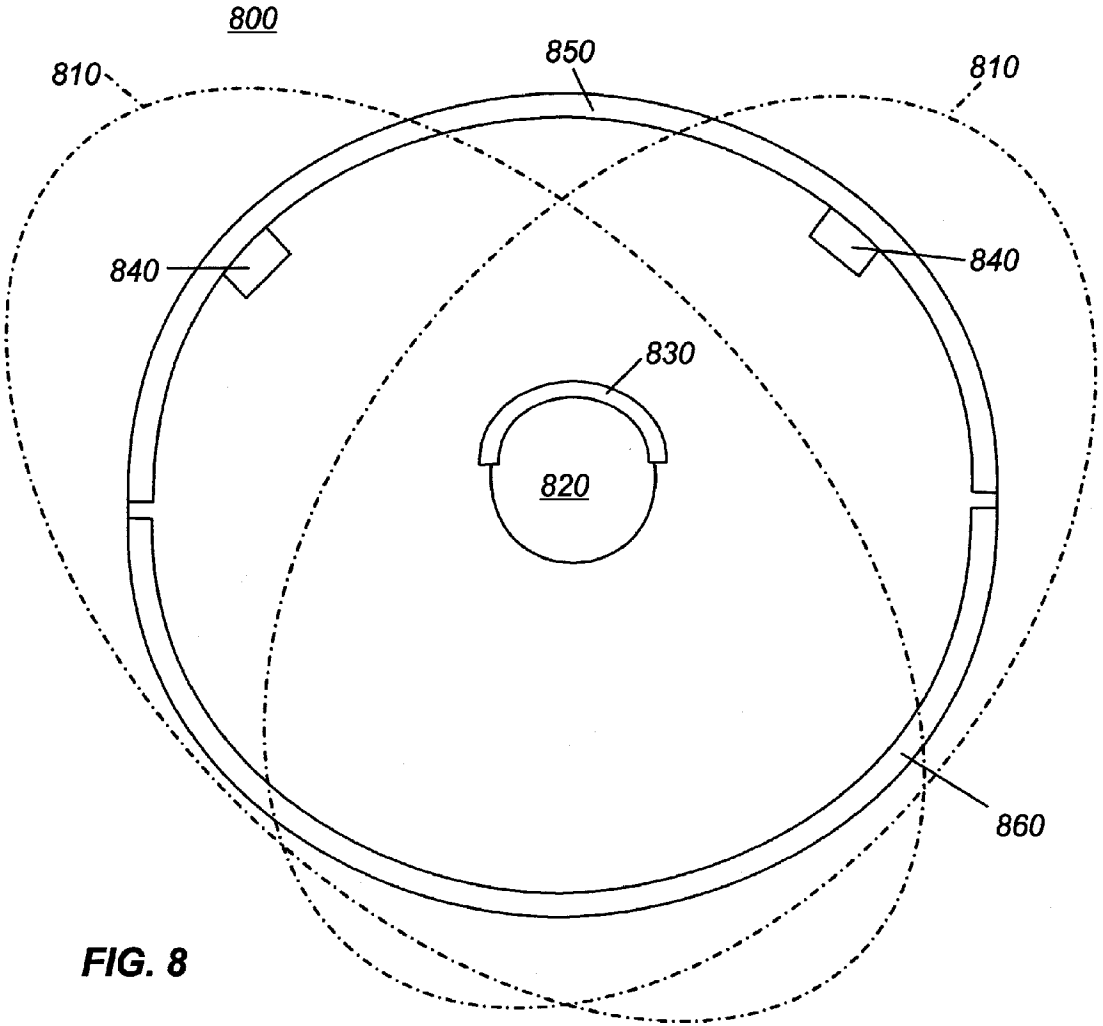
FIG. 8 is a cross-sectional view of a lighting unit having two lighting strips that have a common base reflector and optical elements, in accordance with an embodiment of the invention.

In some embodiments, the lighting unit comprises multiple lighting strips wherein two or more of the lighting strips share one or more component. For example, FIG. 8 shows a cross-sectional schematic of a lighting unit 800 with two lighting strips 810 that may share a common base reflector 820 and/or luminescent material 830. In this embodiment, there may be two arrays of light emitting elements 840 which may be surface mounted LEDs, for example, directed towards a luminescent material strip 830 disposed on a shared base reflector 820. The lighting unit may have a reflective optical element 850 upon which the light emitting elements are mounted that is used to direct light through and out of a second refractive optical element 860. Each lighting strip may comprise its own array of light emitting elements 840 while sharing a common base reflector 820, luminescent material 830 and luminescent optical elements 850, 860. In another example, multiple lighting strips may share light emitting elements. For example, the lighting unit may comprise an array of transparent OLED, transparent LED devices, or devices that emit light from two or more sides or edges, for example. This array of light emitting elements may be shared between multiple lighting strips that each have their own base reflector and luminescent material, for example.

Lighting Unit with Integrated Design

In some embodiments, a lighting unit may have an integrated design with a single support structure for two rows of light emitting elements. FIG. 10*a-e* provides orthogonal views and FIG. 11 provides an exploded view of a lighting unit provided in accordance with an embodiment of the invention.

A lighting unit may have an integrally formed support structure 1000. The support structure may contact one or more circuit board 1006*a*, 1006*b*, having one or more light emitting element disposed thereon 1008. A first optical element 1004 may also contact the support structure and circuit boards. The support structure may support one or more second optical element 1002*a*, 1002*b*. The second optical element may or may not contact the circuit board. A luminescent material may be provided on the second optical element. The first optical element and/or the second optical element may be at least partially or completely reflective. One or more fastener 1010 may keep the lighting unit packaged together.

The lighting unit may have a heat-dissipating support structure formed of a thermally conductive material. A passageway 1012 may be provided between two or more light emitting elements 1008 and/or circuit boards or portions of circuit boards. The passageway may lead into a space 1014 between portions of the support structure 1000.

A support structure 1100 may form a top surface of a lighting unit. One or more second optical elements 1102*a*, 1102*b* may be provided on an underside of the support structure. One or more circuit board 1106*a*, 1106*b* may contact a lower portion of the support structure. The circuit boards may have a plurality of light emitting elements 1108 disposed thereon. The light emitting elements may be located as a row on an outward facing edge of the circuit board. A first optical element 1104 may be located beneath the circuit board and/or support structure. One or more fasteners 1110 may be provided to provide a strong contact between the various components.

Cover

The lighting unit may have a cover to protect the unit from moisture, dirt and/or dust accumulation. The cover may be cleanable and may be made of plastic or glass, for example. In some embodiments, the cover may be transparent or translucent. In one embodiment, the cover comprises a substantially transparent cylindrical plastic sleeve that substantially encases the lighting strips of the lighting unit. The cylindrical shape of the cover may give the lighting unit the shape of a conventional fluorescent tube. The cover need not have a cylindrical shape. The cover may be of other cross sectional designs and may encase any number of the lighting strips or may not fully encase any of the lighting strips.

The cover may be an optical element. The cover can be optically engineered to improve light distribution or light extraction from the lighting unit. For example, the cover or a portion thereof, may have a textured surface, or may have a reflective layer, a lens, a microlens array, a low-index layer, a low index-grid, or a photonic crystal. In one embodiment, the internal upper portion of the cover is coated with a reflective metal to reflect light down and out of the lighting unit. The cover may be configured to convert the spectrum of light emitted by the lighting strip to another spectrum of light of a longer wavelength or shorter wavelength. For example, the cover can comprise a luminescent material such as a phosphor layer, or a quantum-dot-based film that can be configured for down-converting photons of higher energy to lower energy. The cover may also be a tinted or light filtering cover such that colored light may be provided by the lighting unit. The lighting unit may have multiple covers. For instance, each lighting strip within the lighting unit may have its own cover. The covers may be flat or curved pieces covering just a portion of the lighting unit and may provide additional optical control or protection from dust.

In some embodiments, the covers do not cover certain portions of the lighting unit. For example, a cover may not block a passageway that forms a portion of a thermal chimney. This may prevent interference with a cooling convection path. A cover may enclose one or more light emitting elements without enclosing the entire lighting unit. In some embodiments, the cover does not include a top surface of the lighting unit formed of the heat dissipating support structure.

The cover may be configured to be removable and replaceable. For example, the cover may be configured to removably slide or snap onto the support structure of the lighting unit.

In some embodiments, a cover may not be needed for a lighting unit. A coverless lighting unit may be provided with open-air light emitting elements and components as discussed elsewhere herein.

Control Module

The lighting unit is configured to be powered by a power supply. The power supply can be an external power supply or an internal power supply. For example, when a lighting unit is used as a fluorescent tube replacement, the ballast in a conventional fluorescent lighting fixture can be bypassed or removed and replaced with the power supply, such that when the lighting unit is electrically coupled to the receptacles of the conventional fluorescent lighting fixture, the lighting unit is electrically connected to the external power supply. The power supply can be configured to convert wall alternating current to direct current to power the light emitting elements.

The power supply can comprise a control module that can be used to drive the light emitting elements based on information gathered from a sensor, electronic interface, user input or other device, for example. The control module may individually address and control the lighting strips to adjust the color, pattern, brightness, light distribution or to compensate for aging, for example. The control module may be configured to modulate illumination from the light emitting elements. For instance, the control module may drive the lighting unit such that the light emitting elements flash or are activated in a pattern. Furthermore, the control module can drive the light emitting elements using pulse width modulation or amplitude modulation. The control module can be used to dim the light output of the lighting unit.

The control module may individually control light emitting elements or groups of light emitting elements. Alternatively, all of the light emitting elements may be controlled together. The control module can control the light emitting elements in an analog or digital manner.

The control module may include a processor and/or a memory. The control module may include tangible computer readable media which may include code, logic, or instructions for performing one or more step.

Methods

A method for illumination may include providing a lighting unit with one or more of the characteristics as previously described. For example, a method of illumination may include providing a lighting unit with a support structure, a circuit board, and one or more optical element. The method may include emitting light from one or more light emitting elements that may be supported by the circuit board. The method may include providing a remote luminescent material on the lighting unit. The luminescent material may be provided on an optical element of the lighting unit. In some embodiments, the method may include dissipating heat from the light emitting elements.

A method may be provided for assembling the lighting unit. For example, the method of assembly may include sandwiching one or more circuit boards between a support structure and an optical element. The method may optionally include attaching the support structure, circuit board, and optical element using one or more fasteners. A further step may include tightening the fastener to tighten the contact between the support structure, circuit board, and optical element. The method may also include affixing one or more second optical element to the support structure.

In some embodiments, contacting the circuit board with the optical element may include positioning one or more light emitting elements of the circuit board between one or more castellated protrusions of the optical element.

A method for removing heat from a heat source of the lighting unit may be provided. In some embodiments, the heat source may be a light emitting element or back of the light emitting element. The method may include conducting heat away from the heat source. The method may also include providing a convection path on a surface that may receive heat conducted from the heat source. The method of removing heat may include allowing air to rise through a chimney and for air flow to contact the surface of the chimney which may be heated by heat conducted from the heat source, thereby removing heat from the chimney surface.

Advantages

The invention provided herein may offer significant performance and cost advantages. A highly efficient lighting unit may be provided with low cost and improved light output, light distribution, color quality, and color consistency.

The efficiency of the lighting unit may be a function of the LED efficiency, the thermal management, the luminescent material down conversion and scattering, and the optical efficiency of the system. For example, in an LED based fluorescent tube replacement, high efficacy can be obtained by using side-emitting, cool white LEDs with efficiency of about 100 or more lumens per watt in lighting strips in a twin side emitter design. The necessary LEDs for this approach are likely to be readily available considering the large quantities produced for the backlighting market. High power LEDs may report higher efficiencies but the availability, color consistency, and optical distribution of these LEDs could be issues. The thermal conduction from the LED junction to ambient is expected to be superior with the use of a convection path within the lighting unit which will reduce the 'thermal droop' in efficiency of the LEDs. The optical configuration of the design concept may have superior optical efficiency to other LED linear fluorescent solutions which often use a homogenizing lens for beam distribution. The use of a phosphor on the LED chip and a warming remote phosphor on the base reflector may reduce the thermal quenching of the red and/or orange phosphors which are the most thermally sensitive phosphors and may allow the use of even more thermally sensitive phosphors which have higher conversion efficiencies. The use of a large number of medium power LEDs could provide electronic design flexibility allowing for the use of the most efficient power supplies.

Cost advantages of the present work are also significant. For example, the twin side emitter design allows for a cost advantage over other fluorescent tube replacements. The LEDS are generally the most expensive component in a solid state lighting product with power supplies and thermal/mechanical components as the approximately equal next most costly components. However, LED prices are expected to come down rapidly over the next few years. The medium power LEDs which can be used in the twin side emitter lighting unit have a similar cost per lumen as high brightness LEDs which have similar color and efficiency. With the growth of the LED backlighting industry, the price of the medium power LEDs may drop more rapidly than high power LEDs. Furthermore, the thermal management configuration of the twin side emitter design allows for the use of less aluminum heat sink material, and the use of a more distributed light source allows for lower cost optics. The design is inherently manufacturable using off the shelf components such as LEDs, power supply, and circuit boards with custom mechanical and optical parts which can be readily manufactured for low cost. Importantly, this design may reduce the cost of using remote phosphor by depositing phosphor material in concentrated spots and then reflecting the light for distribution. Other approaches that incorporate phosphor throughout the lens require significantly more material and prohibitive cost. Furthermore, the amount of phosphor required for a given amount of light conversion is further minimized by placing the phosphor on a reflector, where the light can experience multiple passes through the luminescent layer.

In addition to cost and efficiency advantages, the present work can provide improved light output, light distribution, color quality, and color consistency. In the twin side emitter fluorescent tube replacement design, for example, the use of primarily reflective optics makes it much easier to control the light distribution, particularly with the use of two reflective surfaces. For color control, homogenization of the cool white output from the LEDs can be accomplished by the controlled use of LEDs with different specific color points. The combined output of these LEDs can be tuned to meet a consistent color point. The specific amount of red and/or orange phosphor materials can also be controlled to adjust the light output. The multiple reflections can also evenly distribute the colors with respect to output angle. Because phosphor materials of the red and/or orange wavelengths are typically most sensitive to heat, locating the phosphor remotely allows for slower degradation and improved lifetime and efficiency of the red and/or orange phosphor which will allow the color set point to be maintained for longer.

Furthermore, lighting units of the present work can be configured as standalone luminaires or may be configured to fit readily into existing luminaires such as linear fluorescent luminaires where existing fluorescent ballasts can be easily replaced with an external power supply matched to the LED system.

EXAMPLES

A lighting unit having one or more of the features described, such as a heat transfer chimney, was tested at multiple National Institute of Standards and Technology (NIST) traceable labs. The lighting unit had a heat dissipating support structure formed of aluminum, LEDs (e.g., NSSW208A surface mounted LEDs from Nichia Corp. of Tokushima, Japan) mounted on a PCB circuit board, a first optical element, and two second optical elements (e.g., which may have a reflective surface material such as WO-F33 high diffuse reflectance film from WhiteOptics LLC of Newark Del.). In one of the tests, a lighting unit had a luminescent material disposed on a second optical element (e.g., Intematix 05446 Eu doped silicate phosphor from Intematix Corp. of Fremont, Calif.). In another test, the lighting unit did not have the luminescent material.

Some measurements were taken in an integrating sphere. An LED drive current of 20 mA per LED was provided. The ambient temperature was 25 degrees C. The lighting unit that had the luminescent material coated on the second optical element yielded a luminous efficacy of 115.5 lumens/Watt. The lighting unit without the luminescent material on yielded a luminous efficacy of 106.6 lumens/Watt.

Conventional lighting units, such as conventional 1" diameter, or T8 fluorescent tube lamps have an efficacy for the bare lamp of about 70-100 lumens/watt. When two T8 fluorescent tube lamps are operated in conventional parabolic troffers, a typical overall luminaire efficacy of approximately 60 lumens/watt is obtained and light output is around 3700 lumens. High efficiency troffers can provide luminaire efficacies typically of approximately 75 lumens/watt and light output of approximately 4000 lumens. Currently available LED-based T8 fluorescent tube replacement products, with bare lamp efficiencies ranging between 70-90 lumens/watt, can have similar luminaire luminous efficacies of approximately 60-80 lumens/watt for two replacement lamps in a parabolic troffer, with a typical light output of 2200 to 3200 lumens. Problems with currently available LED-based fluorescent tube replacement lamps include the low light output, poor light distribution, and high cost that is not adequately offset by improvements in efficacy.

The efficacy of 115.5 lumens/watt and 106.6 lumens/watt for lighting units using the luminescent material and not using the luminescent material, respectively, above show that such prototype lighting units can well surpass the state of the art. The tested lighting units above were four inch prototypes, or 1/12 of the length of a linear fluorescent tube with a light output of 151 lumens and 163 lumens, respectively. A rough estimate of the light output for two full length replacement lighting units can be obtained by multiplying the light output for the four inch sample by 12 to obtain the light output for a single lamp, and doubling the light output to account for two lamps in a troffer, which yield 3624 lumens or 3912 lumens light output for the tested lighting units, respectively. Thus, a lighting unit as described herein advantageously provides a lighting unit with greater luminous efficacy than both existing fluorescent tubes and currently available LED-based T8 replacement products. By requiring less energy, an energy conserving device is provided. Furthermore, the potential for high light output enables these lighting units to be better suited for use as fluorescent tube replacement lamps than currently available replacement products.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A lighting unit comprising:

a substantially linear heat dissipating support structure having a top surface and a bottom surface, and having at least one space between portions of the support structure;

at least two rows of light emitting elements in thermal communication with the support structure and disposed along a length of said support structure between the top surface and the bottom surface; and at least one substantially smooth and uninterrupted finless passageway having substantially solid walls located between the two rows of light emitting elements and extending from the bottom surface to the top surface through the heat dissipating support structure to the space, thereby creating a substantially linear convection path.

2. The lighting unit of claim 1, wherein said heat dissipating support structure is at least one of the following: an aluminum heat sink, a copper heat sink, or an alloy thereof.

3. The lighting unit of claim 1 wherein the heat dissipating support structure has a thermal conductivity of 100 W/m° K or greater.

4. The lighting unit of claim 1, wherein the passageway has a width of greater than 1.5 mm.

5. The lighting unit of claim 1, wherein said convection path is vertically oriented.

6. The lighting unit of claim 1, wherein said heat dissipating support structure comprises one or more of the following heat-dissipating surface features: fins, grooves, rods, pins, or knobs.

7. The lighting unit of claim 1, wherein the space is between parallel portions of the support structure having curved surfaces.

8. The lighting unit of claim 1, wherein said space between portions of the support structure is provided along said length of said support structure.

9. The lighting unit of claim 8, wherein said space is open along the length of the support structure, thereby forming a channel within the heat dissipating support structure.

10. The lighting unit of claim 1, wherein the heat dissipating structure is formed of a single unit.

11. The lighting unit of claim 1, wherein the heat dissipating structure is formed of multiple units.

12. A method of heat dissipation comprising:

providing a heat dissipating support structure having at least one elongated, vertically oriented passageway having substantially solid walls forming a substantially-linear path from a region below said structure to a region above said structure;

providing a plurality of light emitting elements in thermal communication with the heat dissipating support structure and disposed along a length of said support structure, said light emitting elements being located along the at least one elongated, vertically-oriented passageway and between a top surface and a bottom surface of the heat dissipating support structure; and transferring heat from the light emitting elements to the heat dissipating support structure, thereby creating the substantially-linear convection path through the at least one vertically-oriented passageway minimizing resistance to air flow.

13. The method of claim 12, wherein said heat dissipating support structure is at least one of the following: a metal heat sink, or a thermally conductive plastic heat sink.

14. The method of claim 12 wherein the convection path through the space permits air to flow through at least one passageway located between at least two light emitting elements and through the heat dissipating support structure to the space.

15. The method of claim 12, wherein said light emitting elements are light emitting diodes.

16. The method of claim 12, wherein said space between portions of the support structure is provided along said length of said support structure.

17. The method of claim 16, wherein said space is open along the length of the support structure, thereby forming a channel within the heat dissipating support structure.

18. The method of claim 12, wherein the heat dissipating structure is formed with a pair of parallel portions having curved surfaces.

19. A lighting unit comprising:

a heat dissipating support structure having a top surface and a bottom surface, and having at least one space between portions of the support structure;

a plurality of light emitting elements in thermal communication with the support structure and disposed along a length of said support structure between the bottom surface and the top surface; and at least one thermal conduit formed with substantially smooth, solid, and finless walls without heat dissipating surface fins extending through the support structure from the top surface to the bottom surface to form a substantially linear convection path for dissipating heat from the light emitting elements of the lighting unit, and in fluid communication with the at least one space.

* * * * *